US008356547B2

(12) United States Patent
Gray, Jr.

(10) Patent No.: US 8,356,547 B2
(45) Date of Patent: Jan. 22, 2013

(54) VARIABLE LENGTH BENT-AXIS PUMP/MOTOR

(75) Inventor: Charles L. Gray, Jr., Pinckney, MI (US)

(73) Assignee: The United States of America, as represented by the Administrator of the U.S. Environmental Protection Agency, Washington, DC (US)

( * ) Notice: Subject to any disclaimer, the term of this patent is extended or adjusted under 35 U.S.C. 154(b) by 418 days.

(21) Appl. No.: 12/701,438

(22) Filed: Feb. 5, 2010

(65) Prior Publication Data

US 2010/0199837 A1 Aug. 12, 2010

Related U.S. Application Data

(60) Provisional application No. 61/207,021, filed on Feb. 6, 2009.

(51) Int. Cl.
*F01B 9/02* (2006.01)

(52) U.S. Cl. ..... 91/506; 91/505; 92/12.2; 92/13

(58) Field of Classification Search ..... 417/269; 91/505, 506; 92/12.2, 13
See application file for complete search history.

(56) References Cited

U.S. PATENT DOCUMENTS

| | | | | |
|---|---|---|---|---|
| 3,274,948 | A * | 9/1966 | Baits | 91/506 |
| 3,760,692 | A | 9/1973 | Molly | |
| 4,034,650 | A | 7/1977 | Molly | |
| 4,579,043 | A | 4/1986 | Nikolaus et al. | |
| 4,617,853 | A | 10/1986 | Wagenseil et al. | 91/505 |
| 4,951,551 | A * | 8/1990 | Arai et al. | 91/506 |
| 4,991,492 | A | 2/1991 | Bratt et al. | |
| 5,488,894 | A | 2/1996 | Schroder | |
| 5,495,912 | A | 3/1996 | Gray, Jr. et al. | |
| 6,257,119 | B1 | 7/2001 | Ryken et al. | |
| 6,360,647 | B1 | 3/2002 | Alm et al. | 91/491 |
| 6,874,994 | B2 | 4/2005 | Folsom et al. | |
| 7,305,915 | B2 | 12/2007 | Gray, Jr. | |
| 7,594,802 | B2 | 9/2009 | Gray, Jr. | |
| 2004/0173089 | A1 * | 9/2004 | Gray et al. | 91/505 |

FOREIGN PATENT DOCUMENTS

| | | |
|---|---|---|
| GB | 1326921 | 8/1973 |
| WO | 2006115472 A1 | 11/2006 |

* cited by examiner

*Primary Examiner* — Charles Freay
*Assistant Examiner* — Patrick Hamo
(74) *Attorney, Agent, or Firm* — David H. Read

(57) ABSTRACT

In a bent axis hydraulic machine, a back plate and cylinder barrel vary in distance from a drive plate as a stroke angle of the cylinder barrel changes, thereby minimizing unswept fluid volume in the cylinders of the barrel at any stroke angle. Distance is controlled by one or more rollers, engaging respective tracks that define a profile of contact that determines the distance as a function of the stroke angle. Telescoping fluid supply channels are employed to maintain a fluid supply to the cylinder barrel as the distance changes.

27 Claims, 14 Drawing Sheets

VARIABLE LENGTH BENT-AXIS PUMP/MOTOR

CROSS-REFERENCE TO RELATED APPLICATION

This application claims the benefit under 35 U.S.C. §119(e) of U.S. Provisional Patent Application No. 61/207,021, filed Feb. 6, 2009, where this provisional application is incorporated herein by reference in its entirety.

BACKGROUND

1. Technical Field

Embodiments of the present disclosure are related generally to bent-axis hydraulic machines, and in particular to machines in which unswept cylinder volume is controlled to reduce efficiency losses that arise because of compression of hydraulic fluids during operation of the machines.

2. Description of the Related Art

Hydraulic machines are in common use in a wide variety of industrial, commercial, and consumer applications. Hydraulic machines transmit power by conducting pressurized fluid between low pressure and high pressure reservoirs. One general category of hydraulic machines includes machines that employ a rotating barrel with a plurality of pistons positioned in respective cylinders formed in the barrel, each lying parallel to a common axis, and can be called axial piston machines. This general category can in turn be divided into at least two major classes: swash plate and bent-axis.

In both classes, fluid pressure in the cylinders drives the pistons against a plate that lies at an angle with respect to the barrel. In swash plate machines, the barrel rotates on a common axis with a mechanical power shaft of the machine, while the plate is positioned at an angle to both the barrel and the shaft, and does not rotate. In bent-axis machines, the barrel is placed at an angle with respect to the shaft, while the plate lies perpendicular to the shaft and rotates with the shaft. The angle of the barrel (or swash plate, in the case of that class of machine), relative to the shaft, is variable, to vary the displacement of the machine.

Generally speaking, the most efficient and versatile of these machines are the bent-axis machines, which are frequently used for power applications in heavy equipment such as construction and earth moving machines, and may be used to power hybrid vehicles.

The basic design of most axial piston machines potentially allows them to operate both as fluid pumps and as fluid motors, and so these devices are often referred to as pump/motors. When acting as a pump, mechanical power from an external source acts on the mechanical power shaft, which acts as an input shaft to drive the piston/cylinder assembly in a way that creates reciprocal motion of the pistons that in turn results in the pumping of fluid from a low pressure fluid reservoir to a high pressure reservoir. When acting as a motor, fluid from the high pressure reservoir flows in a reverse manner through the piston/cylinder assembly to the low pressure reservoir, causing a reciprocal motion of the pistons that now delivers mechanical power to the shaft, which now acts as an output shaft.

The operation of a typical bent-axis pump/motor 100, operating as a motor, will be described in more detail with reference to FIGS. 1A-1C. While its operation as a pump will not be described in detail, both operations, as a motor and as a pump, are well known in the art.

The term axial force is used herein to refer to force vectors that lie substantially parallel to a defined axis, while the term radial force is used to refer to force vectors that lie in a plane that is substantially perpendicular to a defined axis. Neither term is limited to vectors that intersect the axis. In particular, the radial forces referred to herein generally lie in vectors some distance from the defined axis such that a device that is configured to rotate about the axis, and upon which the radial forces act, will tend to rotate in reaction to the forces.

FIGS. 1A-1C show views of selected elements of the bent-axis pump/motor 100 (referred to hereafter as motor) according to known art. The motor 100 includes a back plate 102 and a cylindrical barrel 104, having a plurality of cylinders 106 within which pistons 108 travel reciprocally. The pistons 108 each have a sliding seal engagement with the wall of the respective cylinder 106, at respective first ends, and engage a socket formed in a drive plate 110, at respective second ends 109 in a ball-and-socket-type coupling. The drive plate 110 is coupled to a mechanical output shaft 120 that is rotationally driven by the motor 100. Typically, bent-axis pump/motors are provided with an odd number of cylinder/piston pairs, usually seven or nine. Cylinder barrel 104 is shown in cross section so that two of a plurality of cylinder/piston pairs are directly opposite each other, as would occur in a barrel having an even number of cylinder/piston pairs, in order to more clearly illustrate the top and bottom limits of travel of pistons 108 within respective cylinders of the cylinder barrel 104, and the relative volumes of fluid constrained by the pistons 108 at the top and bottom of rotation. However, the principles described are common to most bent-axis machines, whether having an even or an odd number of cylinder/piston pairs. Cylinder 106A and piston 108A are shown positioned at the top of the barrel 104 as viewed in the drawings, while cylinder 106B and piston 108B are shown at the bottom of the barrel.

The cylinder barrel 104 is configured to rotate around a first axis A with a face of the cylinder barrel 104 slideably coupled to a valve face 113 of the back plate 102, which does not rotate. While many designs provide a back plate and a valve plate as separate elements, for the purposes of the present disclosure, they will be shown hereafter as a single integrated component. The drive plate 110 rotates around a second axis B at a common rate with the cylinder barrel 104. Typically, a universal joint (not shown) couples the barrel 104 to the drive plate 110.

As the cylinder barrel 104 rotates around axis A, each cylinder 106 follows a circular path around axis A. Because the drive plate 110 rotates at the same rate around axis B, and because second ends 109 of pistons 108 are engaged with drive plate 110, first ends of pistons 108 are caused to reciprocate within respective cylinders 106 except when the axes A and B are coaxial, as shown in FIG. 1C. The uppermost point of that circular path, as viewed in the drawings, is referred to herein as top-dead-center, indicated in FIGS. 1A-1C as TDC, while the lowermost point is referred to as bottom-dead-center, indicated in FIGS. 1A-1C as BDC.

The cylinder barrel 104 and back plate 102, which define axis A, are configured to pivot around a third axis C, with respect to the drive plate 110 and shaft 120, which define axis B, for the purpose of varying the displacement volume of the pump/motor 100, as explained below. Axes A and B lie in the plane of the drawings, while axis C extends normal to the plane of the drawings, and so appears as a point in FIGS. 1A-1C. The degree to which axis A pivots away from a coaxial relationship with axis B is referred to herein as the stroke angle of the motor. The stroke angle determines the distance each piston 108 travels within its respective cylinder 106 as the cylinder barrel 104 rotates, and the volume of the cylinder swept by the piston per rotation of the barrel, and thereby determines the amount of fluid displaced in each revolution, also known as the displacement of the motor. When axes A and B are coaxial, the stroke angle is generally referred to as being at a zero angle, or at a minimum angle, and the pistons do not reciprocate. The stroke angle can be described in terms of degrees—i.e., the angle of axis A relative to axis B—or of a percentage of the maximum angle possible for a given machine, or in more general terms, such as small, large, maximum, minimum, etc.

It is common in the art to establish the stroke angle by providing a pivoting structure known as a yoke, which carries the back plate and cylinder barrel, and pivots around axis C to establish the stroke angle. A yoke commonly includes one or two legs that pivot about respective trunnions rotatably supported by a casing of the motor. It is also common for one or both yoke legs to incorporate fluid passages that provide for a flow of pressurized fluid between the back plate and the trunnions. As used herein, the term yoke refers to a structure having one or two legs that pivot at a first end about a trunnion and carry a back plate and cylinder barrel at a second end through a stroke angle. A yoke may include an integral portion that constitutes a back plate, or have a distinct back plate structure thereto attached.

FIG. 1C shows, in dashed lines 102*a*, 102*b*, the relative position of the back plate 102 at the stroke angles shown in FIGS. 1A and 1B, respectively. It can be seen that an arbitrary reference point P on the back plate 102 follows an arc $E_1$ that is centered on axis C as the back plate 102 changes stroke angle.

FIG. 1A shows motor 100 at a maximum, or 100% stroke angle, which results in a maximum displacement of the motor 100 and a maximum degree of energy transfer. FIG. 1B shows the motor 100 positioned at a moderate stroke angle of approximately 50%, and FIG. 1C shows the motor 100 at a stroke angle of zero, in which the axes A and B are coaxial, and energy transfer is virtually zero.

The term displacement is used to refer to the total volume in the cylinders 106 that is swept by the pistons 108 during a single rotation of the barrel 104. Displacement includes a numerical value and a unit indicating a volumetric measure, such as cubic centimeters, etc. This volume is the amount of fluid that will pass through the motor during each revolution of the shaft 120. Given the displacement value of a pump and its rate of rotation, it can easily be determined how much fluid will be moved over time. When employed as a motor, the displacement value of the machine defines, in conjunction with other pertinent measures such as fluid pressure, the output torque of the machine at that displacement.

In each of the FIGS. 1A-1C, the piston 108*a* positioned in cylinder 106*a* at TDC lies at the outermost limit (OL) to which it will travel within the cylinder over the course of a rotation of the barrel 104, given the stroke angle shown. The position of the face of the piston 108*a* is indicated at line OL. Similarly, piston 108*b*, positioned in cylinder 106*b* at BDC, lies at the innermost limit (IL) to which it will travel within the cylinder 106*b* over the course of a rotation of the barrel 104. The position of the face of the piston 108*b* is indicated at line IL. In any given cylinder 106, the volume that lies between the lines OL and IL represents the displacement of that cylinder 106 at that particular stroke angle. Thus, the displacement of the pump/motor 100 is the sum of the displacements of all of the cylinders 106 of the device at that stroke angle.

When the motor is at its maximum stroke angle, as shown in FIG. 1A, the lines OL and IL lie a maximum distance apart. This is the maximum displacement per cylinder that can be achieved by the pump/motor 100, and provides the highest degree of energy transfer from the high-pressure fluid to the rotation of the drive plate 110, in the form of torque. FIG. 1B shows a moderate stroke angle of about half the maximum angle. It can be seen that the lines OL and IL lie closer together than in FIG. 1A. At this smaller angle, a smaller degree of energy transfer is achieved. When the pump/motor is at a zero stroke angle, as shown in FIG. 1C, the lines OL and IL define the same point because, even though the barrel 104 rotates while at this stroke angle, the pistons 108 do not move axially within the respective cylinders 106, and so do not sweep any volume, but remain substantially stationary near a mid-point of the respective cylinder 106. At the stroke angle shown in FIG. 1C, the drive motor 100 is at zero displacement, and does not exert any radial force to the output shaft 120.

The valve face 113 has two semicircular fluid ports over which the cylinder barrel rotates, so that each cylinder 106 is in fluid communication, first with one of the fluid ports for about half of each rotation, and then with the other of the ports for the other half rotation. One fluid port is coupled to a high-pressure fluid supply, and the other to a low-pressure supply. When the pump/motor 100 is operating in a motor mode, high-pressure fluid begins to enter each cylinder 106 as the respective cylinder passes TDC, and continues to enter until the cylinder reaches BDC. The high-pressure fluid applies a driving force on the face of the respective piston 108 that acts on the piston axially with respect to axis A. This force is transferred by the piston 108 to the drive plate 110 as the barrel 104 rotates through 180 degrees, until the respective cylinder 106 passes BDC, at which point the cylinder is placed in fluid connection with the low-pressure fluid supply, and the piston 108 pushes the fluid out of the cylinder 106 as the cylinder 106 continues to rotate back toward TDC.

Referring to FIG. 1A, it can be seen that the driving force on the pistons 108 is axial, relative to axis A, but will include both axial and radial force components, relative to axis B. The distribution of the driving force between the axial and radial components depends on the stroke angle of the pump/motor, and can be calculated in accordance with well known and long established mechanical principles. The axial component will tend to exert a force on drive plate 110 away from the barrel 104 along axis B, which is resisted by elements such as thrust bearings etc., which are well known in the art. The radial component will exert a force on the socket of the drive plate 110, into which the second end 109 of a given piston 108 is seated to urge that socket downward, as viewed in the drawings, causing drive plate 110 to rotate so that that socket moves further away from the barrel 104, with the barrel 104 rotating in unison with the drive plate. Only radial force is converted to energy, in the form of torque.

The smaller the stroke angle, the more of the exerted force will be distributed to the drive plate as an axial force, until, at a zero stroke angle, such as that shown in FIG. 1C, all of the exerted force is distributed to the drive plate 110 as an axial force, with none being applied as a radial force. Accordingly, even though the cylinders 106 are fully pressurized at the zero stroke angle, there is no torque applied to the output shaft 120, which is therefore free to rotate independently of the fluid system. In the case of a vehicle that is powered by such a motor, a zero stroke angle might be indicated when the vehicle coasts, and no power needs to be delivered to or retrieved from the drive wheels.

Hydraulic bent-axis pump/motors are described in a large number of patents, including the following U.S. Pat. Nos. 3,760,692; 4,034,650; 4,579,043; 5,488,894; 5,495,912; 6,257,119; 6,874,994; and 7,594,802, all of which are incorporated herein by reference, in their entireties.

In FIGS. 1B and 1C, it can be seen that a volume 119 exists beyond the outer limit of travel of the piston 108*a* at TDC that is not swept by the piston at that stroke angle. Owing to the geometry of the device, a significant unswept volume will exist at any stroke angle smaller than the maximum angle (shown in FIG. 1A), with the largest unswept volume occurring at a zero stroke angle. As the device operates, this unswept volume 119 is always occupied by fluid, which is subjected to low and high pressure extremes during the course of each revolution even though it does not participate in transmitting power.

While hydraulic fluids are considered to be effectively non-compressible in many contexts, they are in fact slightly compressible, leading to undesirable mechanical effects such as fluid hammer, noise, and volumetric leakage. The unswept volumes 119 of the depicted prior art bent-axis design are a source of such undesirable effects. Because the potential for such effects tends to be proportional to the volume compressed and the magnitude of pressure, prior art bent-axis machines are particularly susceptible to these effects at high operating pressures and virtually all stroke angles. This poses a problem for their use in hybrid vehicle applications, because such applications tend to call for high maximum operating pressures, and high efficiency and minimum noise over a broad range of stroke angles.

Compressibility-related leakage is a particular concern for efficiency. Within the range of fluid pressures that are typical with hydraulic motors, the volumetric compressibility of hydraulic fluid is generally around 1% per 1,000 psi. Thus, if the high-pressure fluid supply of a motor is at 5,000 psi, the fluid in each of the cylinders will compress by about 5% each time the respective cylinder switches from low pressure to high pressure, and decompress by the same amount each time the respective cylinder switches from high pressure to low pressure. This means that whatever the stroke angle of the motor, an amount of fluid equal in volume to about 5% of the fluid in the cylinder will be lost to the low-pressure side of the system each time the cylinder crosses BDC.

Referring again to FIGS. 1A-1C, the volume of fluid in the cylinder 106*b* at BDC (where it switches to low pressure) decreases as the stroke angle diminishes, which means that the fluid loss due to fluid compressibility also diminishes. However, the impact of that fluid loss on motor efficiency increases as stroke angle diminishes, because the fluid loss—which is directly proportionate to the fluid volume at BDC—drops by about 50% between maximum displacement and zero displacement, while power output of the motor drops by 100% over the same range. It can be seen, for example, that at a minimum stroke angle, as shown in FIG. 1C, where the pistons 108 do not move axially in respective cylinders 106 as the cylinder barrel 104 rotates, each cylinder is continually about half full of fluid. Each time the cylinder crosses TDC, a small amount of fluid is added as this volume of fluid is compressed by about 5% (assuming a fluid pressure of around 5,000 psi). As each cylinder subsequently crosses BDC, the fluid decompresses and the small amount of fluid escapes to the low-pressure side. Thus, when the motor is coasting at zero displacement, there is no power output, but the fluid loss is still about half of the maximum. In motors that frequently operate in the lower displacement range, this can have a significant impact on overall efficiency of the motor.

Noise and vibration are another concern. As the fluid in each cylinder is compressed at TDC, and again as it is decompressed at BDC, a small pulse, or fluid hammer, is generated. If there are nine cylinders in the cylinder barrel, eighteen such pulses will be generated for each revolution of the barrel. These pulses create vibration and noise in the motor as it rotates. Such vibration has not previously been a particular concern because use of hydraulic machines of the kind described above has traditionally been substantially limited to applications in heavy industries and the industrial workplace. However, as hydraulic machines are being adapted for use in hybrid vehicles that operate on public roads and carry passengers, noise and vibration become a much more important consideration, affecting the comfort of people around the vehicles as well as that of the passengers. Passenger vehicles, especially, are subject to highly competitive consumer marketing, and undesirable noise or vibration can have a significant negative impact on the market value of a vehicle.

The problem posed by unswept volume remaining in the cylinders at small stroke angles has been addressed to some degree in prior art. For example, U.S. Pat. No. 3,760,692 (Molly) discloses a bent-axis hydrostatic drive unit that utilizes an off-center pivot such that the dead space within each cylinder is reduced at all stroke angles. The off-center pivot serves to vary the axial distance between a drive plate and a cylinder barrel as a function of stroke angle, in order to modify the outer limit of reciprocation of the pistons to a point closer to the outer end of the cylinders. Bent-axis hydraulic machines that seek to modify unswept volume as a function of stroke angle in this way will henceforth in this disclosure be referred to as variable length. In this usage, variable length refers specifically to the variable nature of the axial distance between a drive plate and a cylinder barrel as a function of stroke angle.

Advantages of a variable length design will be made more apparent with reference to FIGS. 2A-2C. A hydraulic motor 200 is shown in FIG. 2A at a similar stroke angle to that of motor 100 as shown in FIG. 1A, and, likewise, the motor 200 of FIGS. 2B and 2C is shown at angles that correspond to the angles of the motor 100 as shown in FIGS. 1B and 1C, respectively.

The cylinder barrel 104 and back plate 202 of motor 200 can be seen to move closer to drive plate 110 as they pivot together about axis C from a larger stroke angle to a smaller stroke angle. The result of this movement is that the outer limit of travel of the pistons 108 at TDC remains close to the outermost end of respective cylinders 106, regardless of the stroke angle. For example, referring to FIG. 2C, it can be seen that pistons 208*a* and 208*b* are both positioned at the outer end of the cylinder 106, and unswept volumes 119*a*, 119*b* between the outer limits OL and the outer ends of the cylinders 106 is virtually zero.

The dashed lines 202*a* and 202*b* of FIG. 2C show the relative positions of the back plate 202 at the stroke angles shown in FIGS. 2A and 2B, respectively. In contrast to the prior art motor 100 of FIGS. 1A-1C, a reference point P on the back plate 202 follows an arc $E_2$ that is not centered on axis C, but that is centered on an axis F near the second end 109 of the piston 108*a*. The amount of compression loss typically associated with smaller stroke angles is thereby reduced, improving the efficiency of the motor 200 and reducing its noise and vibration.

However, the design of FIGS. 2A-2C, using an off-center pivot around which the back plate and cylinder barrel pivot, inhibits over-center operation because one side of the pivoting structure is rigidly fixed. Also, the maximum angle of pivot is potentially limited by geometric interference such as piston rod contact with the cylinder barrel.

BRIEF SUMMARY

According to various embodiments, a hydraulic machine is provided, including a drive plate and an output shaft configured to rotate about a first axis, and a cylinder barrel configured to rotate about a second axis, the cylinder barrel having a plurality of cylinders and a corresponding plurality of pistons positioned therein, each bearing against the drive plate for transfer of drive force. The first and second axes intersect at a third axis that lies perpendicular to the first and second axes. A back plate supports the cylinder barrel and includes a valve surface over which the cylinder barrel rotates. Displacement control means are provided, which control an angle of the second axis relative to the first axis. Displacement control means are also referred to herein as angle control means. Axial position control means are provided, which control a distance, along the second axis, of the cylinder barrel from the third axis.

According to an embodiment, the axial position control means controls translation of the back plate along the second axis so as to control a distance between the cylinder barrel and the third axis.

According to an embodiment, the axial position control means includes a fluid channel that is coupled to the back plate via a telescoping junction, which accommodates translation of the back plate along the second axis while maintaining fluid communication of the back plate with a source of pressurized fluid.

According to an embodiment, the displacement control means includes a yoke that is pivotable around the third axis, and to which the back plate is coupled. A fluid channel extending in a leg of the yoke is coupled to the back plate via a telescoping junction, which accommodates translation of the back plate along the second axis while maintaining fluid communication of the back plate with a source of pressurized fluid.

According to an embodiment, a distance between the cylinder barrel and the third axis is reduced as the stroke angle is reduced, and increased as the stroke angle is increased. According to an embodiment, the axial position control means includes a track coupled to an inner surface of a casing of the machine, and also a roller that is coupled to the back plate in a position where the roller can engage the track. A profile of the track is selected so that as the angle of the second axis relative to the first axis changes, the distance between the cylinder barrel and the third axis is controlled by movement of the roller along the track. Hydrostatic forces acting on various surfaces of the machine are selected to produce a net force on the back plate and roller that will tend to bias the roller against the track.

DETAILED DESCRIPTION

Figure 1A:
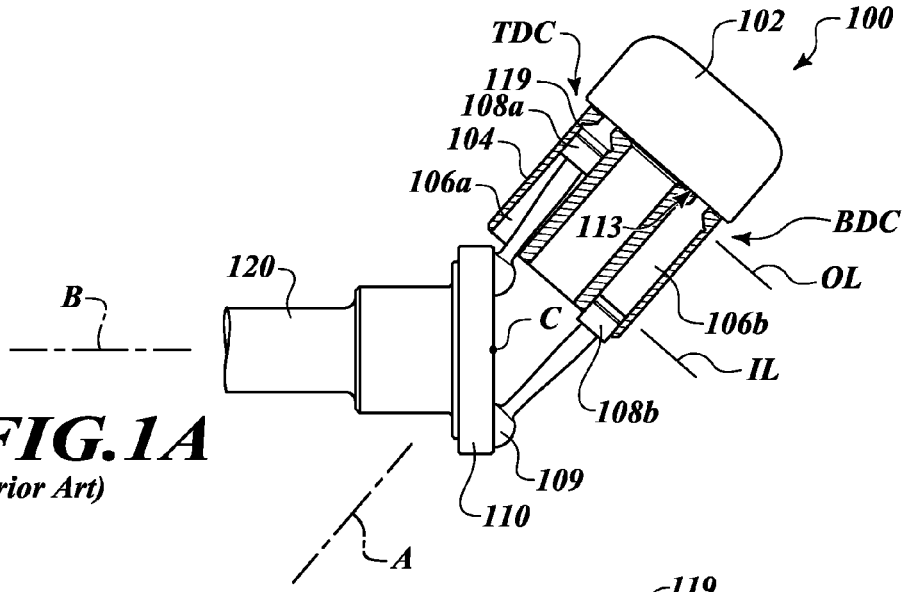
FIG.1A (Prior Art)
FIGS. 1A-1C show views of selected elements of a hydraulic motor at respective stroke angles, according to known art.
Figure 1B:
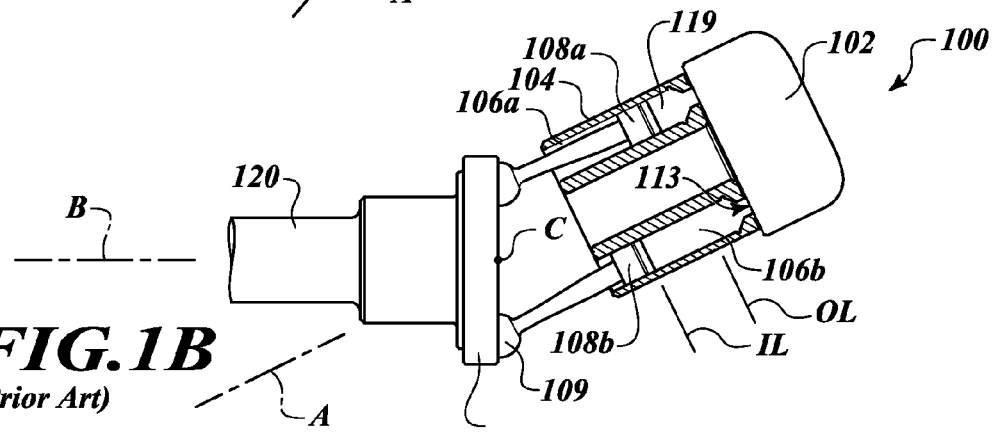
FIG.1B (Prior Art)
Figure 1C:
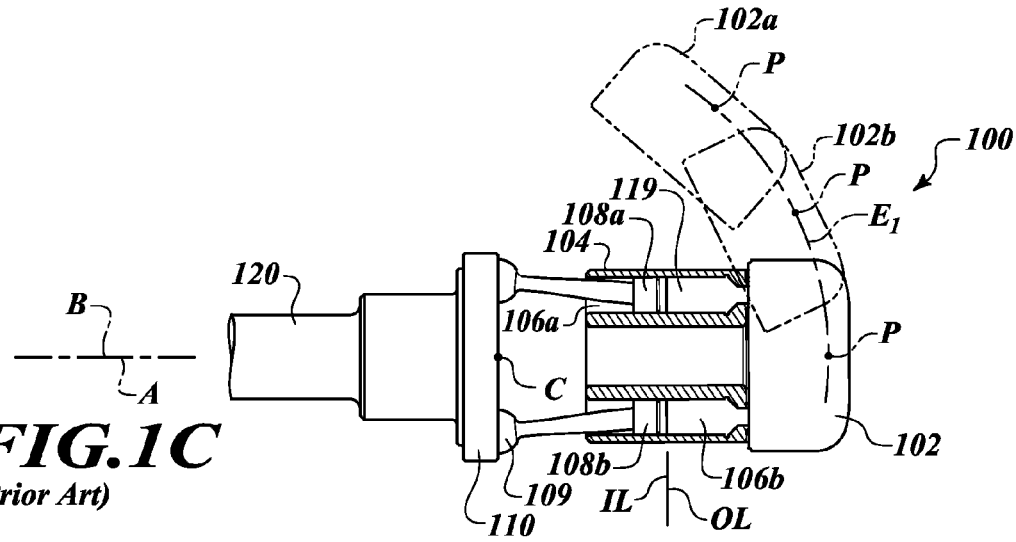
FIG.1C (Prior Art)
Figure 2A:
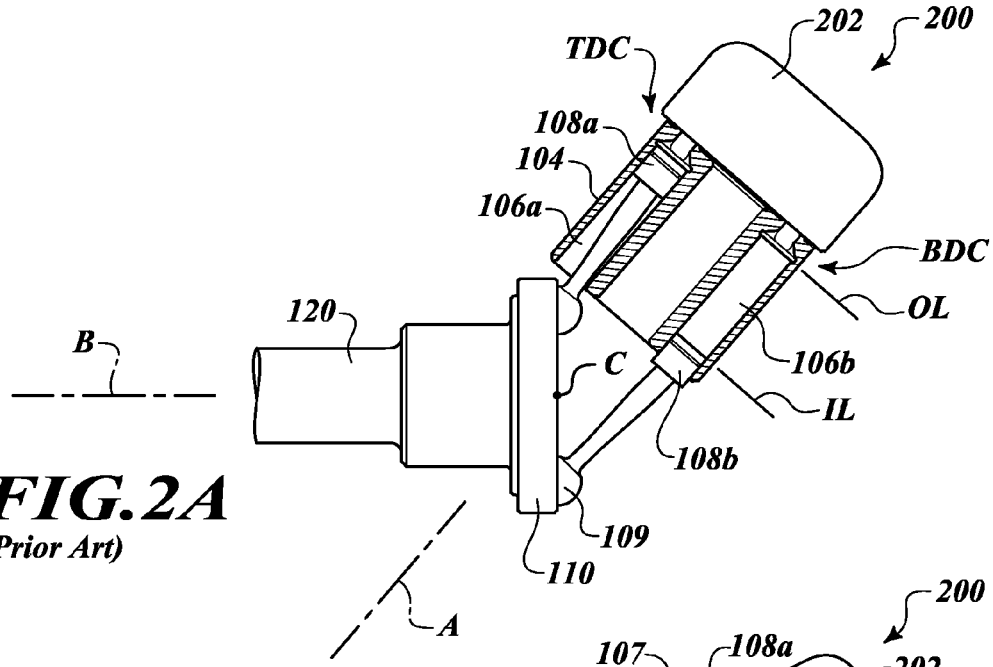
FIG.2A (Prior Art)
FIGS. 2A-2C show views of selected elements of a variable-length hydraulic motor according to known art, at stroke angles corresponding generally to the stroke angles of the hydraulic motor of FIGS. 1A-1C, respectively.
Figure 2B:
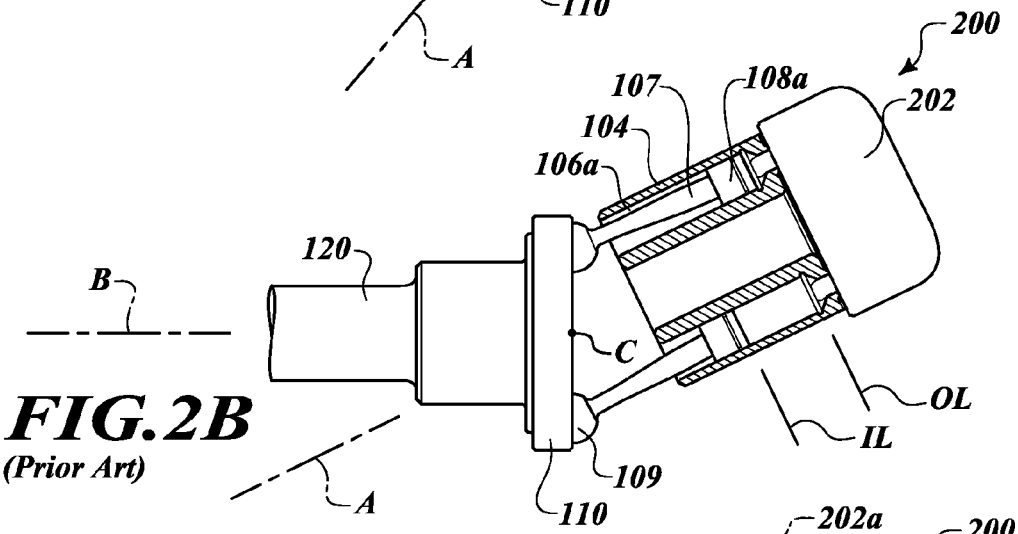
FIG.2B (Prior Art)
Figure 2C:
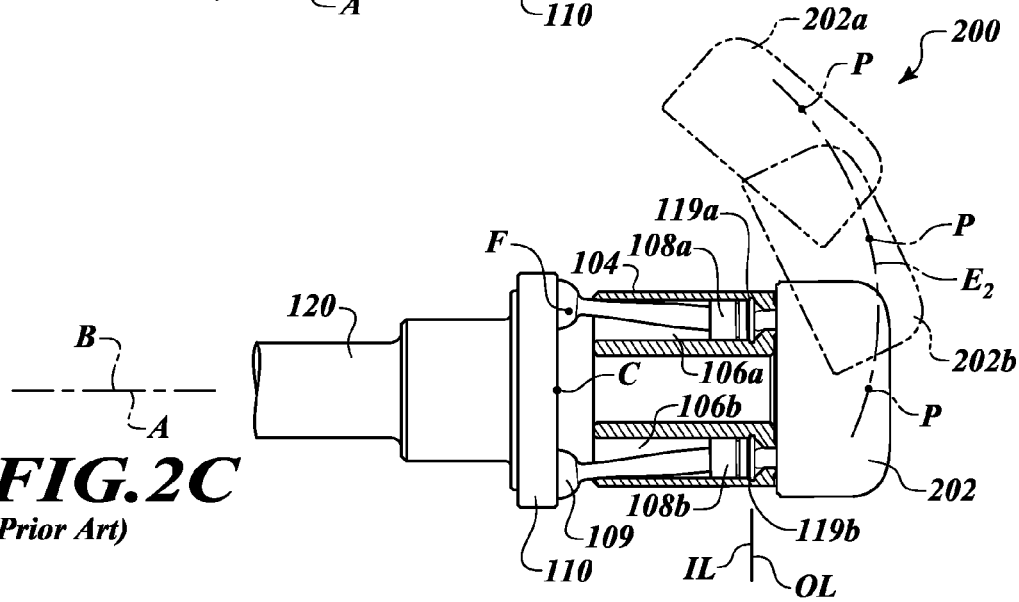
FIG.2C (Prior Art)

The term motor is used generally, in describing various embodiments. This is to be understood as including motors and pumps. Likewise, the element referred to as the output shaft of a motor is to be understood as being the input shaft of a corresponding pump. The terms high pressure and low pressure are used to distinguish elements of machines of various embodiments, e.g., a "high-pressure fluid passage," or a "low-pressure port." This is done for the purpose of clearly describing the structures and operation of the embodiments. However, it is well known that many hydraulic machines are configured to be reversible by switching fluid polarity of the motor, so that torque is applied in an opposite direction. Thus, during forward operation of a motor, a given machine port might be referred to as a high-pressure port, but when polarity is reversed, the same port would become a low-pressure port. Even in the case of the over-center motors discussed below, which are not normally switched during operation, there is no inherent reason why they also could not be reversed in the same way. Unless explicitly recited, the claims are therefore not to be limited by a literal restrictive use of these terms in the disclosure.

As used in the disclosure, terms such as outer, outward, and outwardly are used to refer to movement, bias, or relative distance from the axis C of a given motor, so, for example, a reference to an outward bias indicates a bias away from the axis C. Conversely, terms such as inner, inward, and inwardly are used to refer to movement, bias, or distance as being toward or closer to the axis C. Additionally, the axis C can be thought of as extending from side to side in a given motor. Other terms referring to position or movement, including, for example, right, left, top, bottom, above, and below, are generally to be understood as referring to a given element or action as viewed in the drawings. The stroke angle of a motor can be thought of as increasing as the yoke pivots in a counterclockwise direction, as viewed in the drawings, and as decreasing as the yoke pivots clockwise. Directional and positional terms like those mentioned above are used to simplify and clarify the disclosure of the various embodiments. Only those claims that explicitly recite such terms are limited thereby.

The various disclosed embodiments are shown in the drawings as having an even number of piston/cylinder pairs. This is merely for convenience, and is not to be construed as limiting the scope of the claims in any way.

Figure 3:
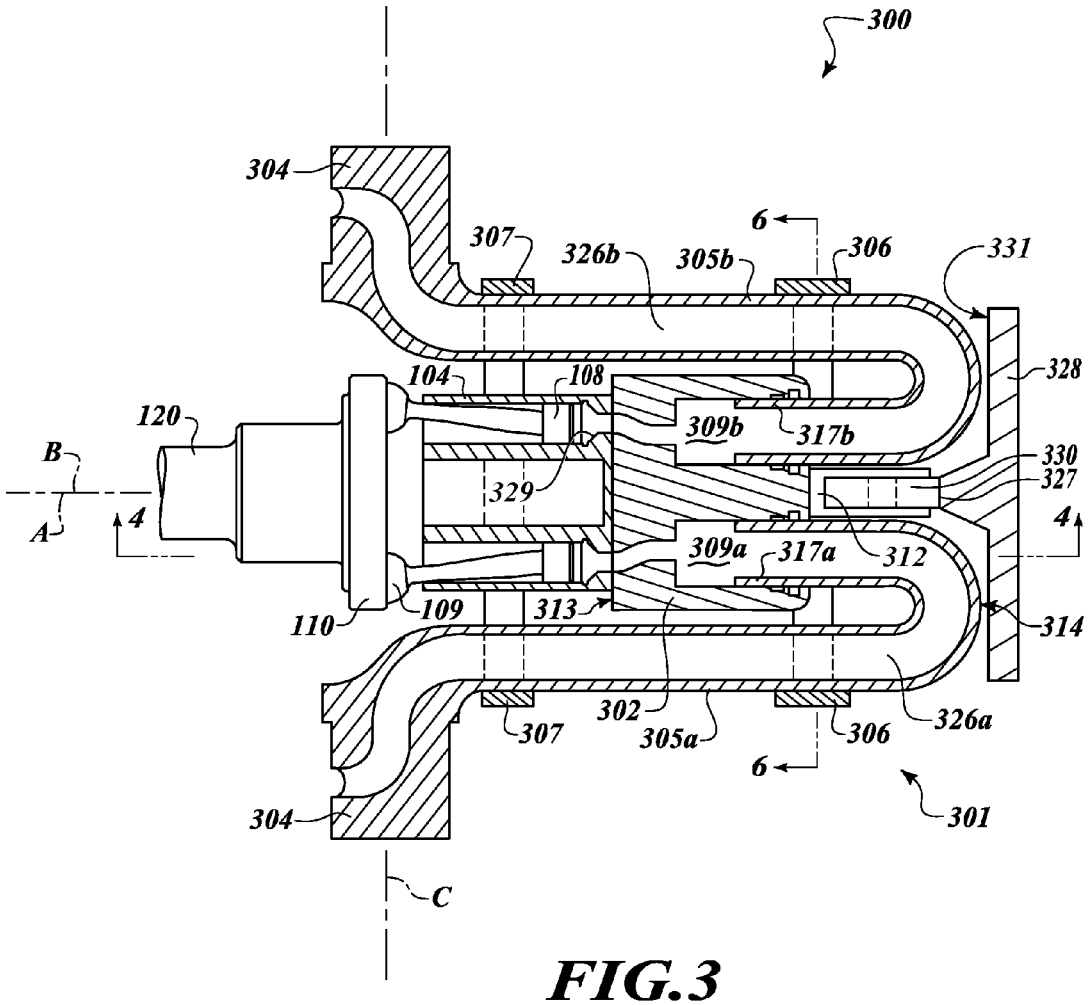
FIG. 3 shows selected elements of a variable length hydraulic motor in a partial sectional view taken along a selected plane, according to one embodiment.
Figure 4:
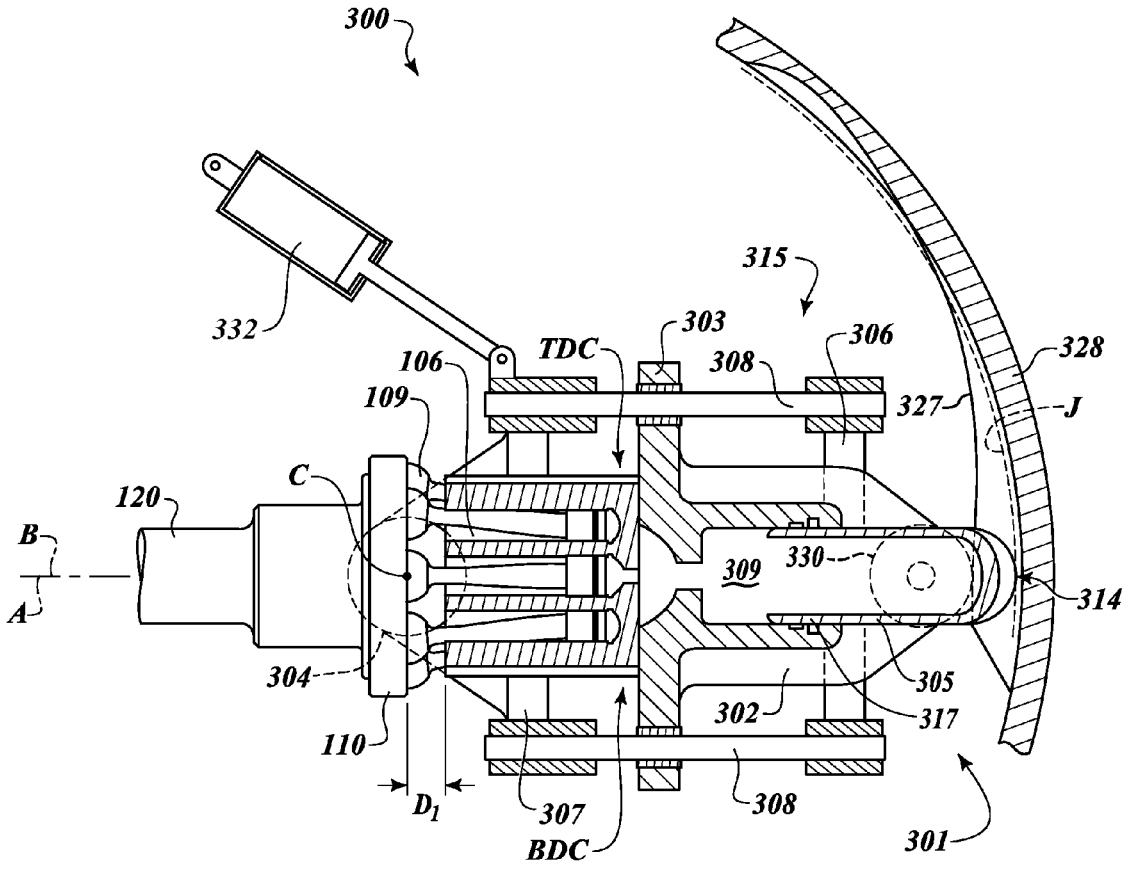
FIG. 4 shows the hydraulic motor of FIG. 3 in a sectional view taken along lines 4-4 of FIG. 3.
Figure 5:
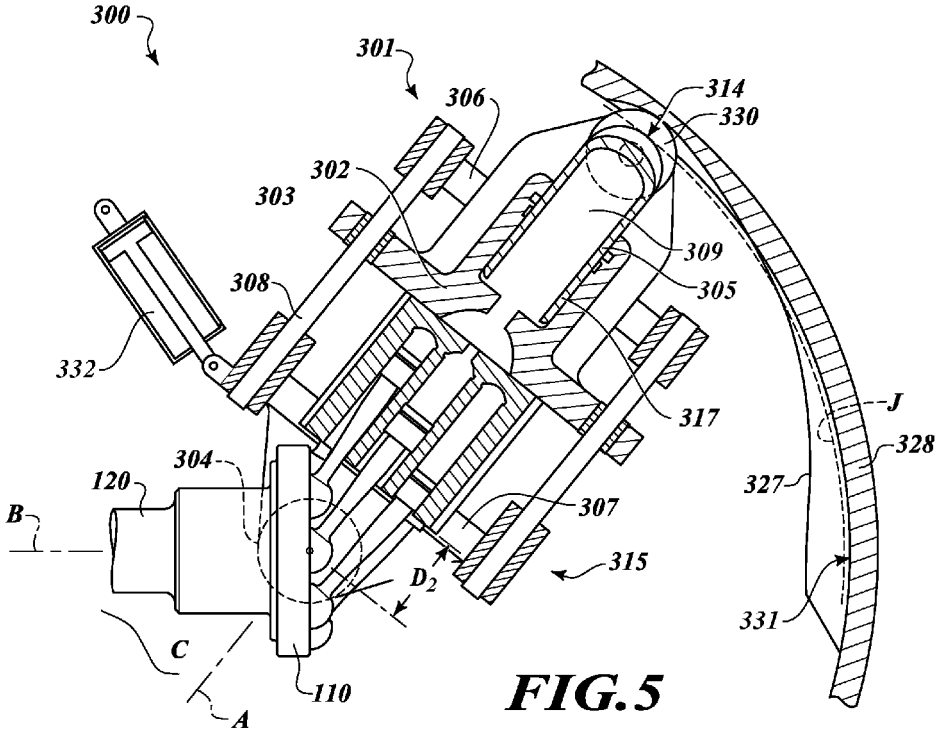
FIG. 5 shows the hydraulic motor of FIG. 4 at a maximum stroke angle.

FIGS. 3-5 show, according to one embodiment, elements of a variable length bent-axis pump/motor 300. FIG. 3 shows the motor 300 in a partial sectional view taken along a plane defined by the axes B and C. As with the motors 100 and 200 described above, axis A is defined by the cylinder barrel 104, and therefore pivots, with respect to axis B, as the stroke angle of the motor 300 changes. While the motor 300 is at a zero stroke angle, as shown in FIGS. 3 and 4, axis A lies in the plane defined by the axes B and C. FIG. 4 shows the motor 300 in a cross-sectional view taken along lines 4-4 of FIG. 3, while FIG. 5 shows the same view as in FIG. 4, with the motor 300 at a maximum stroke angle.

The motor 300 includes a drive plate 110, an output shaft 120, a cylinder barrel 104, and pistons 108, substantially as described with reference to motors 100 and 200 of FIGS. 1A-2C. Additionally, the motor 300 comprises a back plate 302 and a yoke 301. An actuator 332, shown diagrammatically in FIGS. 4 and 5, is provided to control the stroke angle of the motor 300. Mechanisms and controls for controlling the stroke angle of a motor are not discussed in detail in the present disclosure, but are well known in the art.

The yoke 301 includes a high-pressure yoke leg 305*a*, a low pressure yoke leg 305*b*, trunnions 304 coupled to respective yoke legs, and a brace frame 315. The yoke legs 305*a*, 305*b* include respective fluid passages 326*a*, 326*b*. In the embodiment of FIGS. 3-5, the yoke legs extend outward from the trunnions 304 to an outer portion 314, then double back toward the axis C, so that second ends 317 of the fluid passages 326 open in an inward direction, toward the back plate 302. The trunnions 304 are coupled to a casing at respective sides of the motor 300, and are provided with bearing and seal assemblies, which permit the yoke 301 to pivot about the axis C while maintaining a fluid coupling with fluid passages of the casing. The sides of the motor and the bearing and seal assemblies are not shown, but are well known in the art.

The brace frame 315 includes outer and inner braces 306, 307 that are rigidly coupled to the yoke legs 305, and yoke shafts 308 extending between the outer and inner braces, as described with reference to FIGS. 4 and 5.

The back plate 302 includes high- and low-pressure junction ports 309*a*, 309*b* that receive second ends 317*a*, 317*b* of the yoke legs 305*a*, 305*b*, respectively, in a slidable coupling. The slideable coupling of the junction ports 309 to the yoke leg ends 317 permits axial movement, along axis A, of the back plate 302 relative to the yoke legs 305, while providing fluid-tight passages for flow of hydraulic fluid between the yoke legs and the back plate 302. Translation brackets 303 of the back plate 302 slidably engage the yoke shafts 308 and serve to limit or prevent non-axial movement of the back plate relative to the yoke 301. A valve face 313 of the back plate 302 provides a bearing surface on which the cylinder barrel 104 rotates. A roller 330 is rotatably coupled to the back plate 302 by a roller bracket 312 on a side opposite the valve face 313. The roller 330 engages a track 327 located on an inner surface 331 of the motor casing 328, a portion of which is shown in FIGS. 3-5. While the roller 330 is shown in FIG. 3 as a single roller, it can comprise a larger number of individual rollers, according to the design considerations of a particular application.

As discussed in more detail later, the motor 300 is configured such that fluid pressure acting on the back plate 302 and cylinder barrel 104 biases the back plate, cylinder barrel, and roller 330 in an outward direction, i.e., rightward, as viewed in FIG. 3, against the track 327 at all times during operation of the motor 300. Thus, the axial position of the back plate 302 and cylinder barrel 104, at a given stroke angle, is controlled by a distance, extending along axis A, between axis C and the point where the roller 330 engages the track 327 at that angle.

While operating as a motor at a non-zero stroke angle, high-pressure fluid travels through the passage 326*a* and high-pressure junction port 309*a* to the cylinders 106 as each cylinder rotates across the high-pressure side of the valve plate. After the cylinders 106 cross BDC, the fluid passes into the low-pressure junction port 309*b*, and from there to the low-pressure passage 326*b*, as the respective piston is pushed back into the cylinder as the cylinder rotates toward TDC.

In FIG. 4, the motor 300 is shown at a zero stroke angle. With the motor 300 at this angle, in can be seen that the portion of track 327 against which the roller 330 bears is some distance inward from the inner surface 331 of the casing 328. Consequently, the roller 330, back plate 302 and cylinder 104 are shifted along axis A, toward axis C, so that a distance $D_1$ between the drive plate 110 and axis C is relatively small, and the unswept volume in the cylinders 106 is significantly reduced, as compared to otherwise equivalent conventional hydraulic machines. As the yoke 301 pivots about axis C (counter-clockwise, as viewed in FIG. 4), and the stroke angle of the motor 300 increases from zero, fluid pressure continually biases the roller 330 outward against the track 327, so that as the distance of the track from the axis C increases, the back plate 302 moves axially along axis A, and the distance between the drive plate 110 and axis C also increases. The shape, or profile, of the track 327 is selected to minimize the unswept volume between the outer limits of each piston 108 and the outer ends of the cylinders 106, thereby reducing or eliminating fluid compression losses that otherwise occur in the unswept volume of the cylinders. Because the distance from axis C to the track 327 increases with stroke angle, back plate 302 travels axially outward as the stroke angle increases, and inward as the stroke angle approaches zero.

FIG. 5 shows the motor 300 at a maximum stroke angle. Compared to the view of FIG. 4, it can be seen that axis A has pivoted with the yoke 301 around axis C. The roller 330 now contacts a portion of the track 327 that is at a greater distance from axis C, compared to the distance at the zero stroke position shown in FIG. 4. Accordingly, the back plate 302 has moved axially along axis A to a position that is farther from axis C, and the distance $D_2$ between the drive plate 110 and axis C, as shown in FIG. 5, can be seen to be much greater than the distance $D_1$ shown in FIG. 4.

While the back plate 302 is made to translate along axis A as the stroke angle changes, the outer end 314 of the yoke 301 follows an arc J that is centered on the axis C, as shown in FIGS. 4 and 5.

In addition to transmitting fluid to and from cylinder barrel 104, the yoke 301 and trunnions 304 serve to maintain proper alignment of the cylinder barrel 104, so that axes A and B always intersect at axis C, at any stroke angle. This alignment ensures the most efficient transfer of forces by the pistons to the drive plate 110, and prevents contact of the pistons 108 with the side walls of cylinders 106, which would occur if the intersection were to deviate more than a small distance from axis C. In this regard, by maintaining the alignment of the cylinder barrel (and axis A) with axis C, changes in distance between cylinder barrel 104 and drive plate 110 always occur along axis A.

Figure 6:
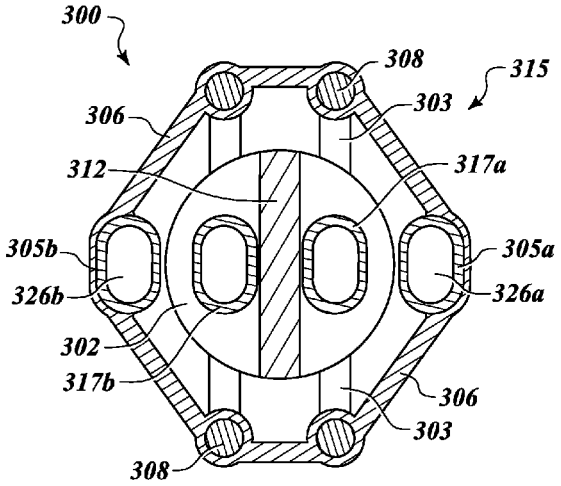
FIG. 6 is a cross-sectional view of the motor of FIG. 3, taken along lines 6-6.

FIG. 6 is a sectional view of the motor 300 taken along lines 6-6 of FIG. 3, and shows, in particular, the outer braces 306 according to an embodiment. The outer and inner braces 306, 307 of the brace frame 315 serve to hold the yoke legs 305 and the yoke shafts 308 rigidly parallel, which in turn maintains the alignment of axis A with axis C. The configurations and numbers of braces and yoke shafts can be selected according to the requirements of a particular application. For example, in the embodiment of FIG. 6, four yoke shafts are provided, while in other embodiments, two yoke shafts are provided.

During operation, tremendous forces are produced by the high-pressure fluid in cylinders 106 of motor 300. As explained in more detail with reference to FIGS. 1A-1C, those forces are transmitted as axial and radial forces to drive plate 110, in a distribution that is determined by the stroke angle. A corresponding reaction force is directed against the back plate 302, axially, with respect to the cylinders 106, and parallel to axis A. In many prior art systems, these forces are supported entirely by the yoke, and are transferred to the motor casing by the trunnions, which must therefore be substantially reinforced and strengthened to control distortion caused by the forces on the mechanism. This is particularly problematic because high- and low-pressure fluid is also transmitted between the cylinder barrel and the fluid sources via the trunnions, and a rotating seal is required where fluid is transmitted between the trunnions and external fluid transmission paths. Distortion of the yoke and trunnions arising from the reaction force can compromise the seals between the trunnions and the casing, and result in fluid loss at the trunnions. Such considerations are discussed in detail in U.S. Pat. No. 7,305,915.

According to the embodiment of FIGS. 3-5, much of the reaction force is transmitted to the casing 328 via the roller 330, which means that the load borne by the trunnions 304 is greatly reduced as compared to prior art systems. Accordingly, the strength and mass of the yoke and trunnions can also be reduced, relative to the prior art, resulting in a reduction in size and weight of the overall machine. The portion of casing 328 that includes track 327 is much less sensitive to the effects of the reaction forces because it is joined to other casing sections by static seals only, and because those seals are only required to withstand the relatively low pressure of fluid in the interior of the casing.

To simplify the discussion of forces, an outwardly acting force will hereafter also be referred to as a positive force, and an inwardly acting force will also be referred to as a negative force.

Fluid pressure acts on a large number of surfaces within a typical hydraulic motor to produce the forces referred to above. The strongest of these forces are produced in passages, chambers, and cylinders where force applied to one or more surfaces is not transmitted to the structure, while force applied to an opposing surface is transmitted. This is the case, for example, in the cylinders of the cylinder barrel. Pressure acting on the surface of a piston produces an inwardly acting—negative—axial force that drives the piston out of the cylinder. The force is not transmitted to the barrel, but is instead transmitted to the drive plate of the motor, as described with reference to FIGS. 1A-1C. Meanwhile, pressure acting on shoulders 329 within the cylinder at the end closest to the valve plate produces a powerful positive force that is transmitted to the barrel. Accordingly, forces acting on the barrel are not balanced, but have a net positive value, so the barrel is biased in an outward direction by the sum of forces acting thereon. This force is transmitted by the barrel to the valve face of the back plate. Ultimately, all of the inwardly directed negative drive force transmitted by the pistons to the drive plate is opposed by an equal outwardly directed positive drive force that is a sum of forces acting on various components of the motor. The present discussion will be directed primarily to four of those forces, which are dominant factors in determining how the outwardly directed drive force will be distributed within the motor.

Figure 7:
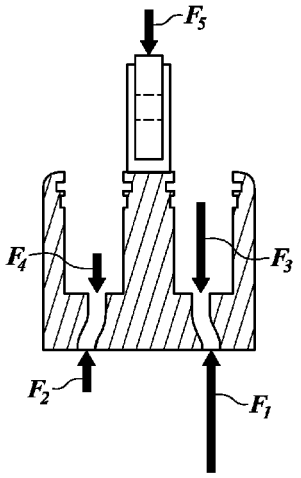
FIG. 7 shows a back plate of the hydraulic motor of FIG. 3, illustrating forces acting thereon.

FIG. 7 illustrates fluid forces that are exerted upon the back plate 302 by pressurized fluid traveling through the device. As pressurized fluid occupies a plurality of cylinders in the cylinder barrel, the back plate 302 is acted upon in the outward direction by axial force components shown here as $F_1$, which represents the positive-acting force exerted in the cylinders in which high-pressure fluid is present, and $F_2$, which represents the positive-acting force exerted in the cylinders in which low-pressure fluid is present. High-pressure fluid in the high-pressure junction port 309*a* exerts a separation force between the second end 317*a* of the yoke leg 305*a* and the back plate 302. $F_3$ represents the negative acting component of the separation force that is applied to the end surface of the junction port 309*a*. Fluid in the low-pressure junction port 309*b* exerts a similar but smaller negative separation force $F_4$. As noted above, the motor 300 is configured such that a net fluid pressure acting on the cylinder barrel 304 and back plate 302 always biases those components in an outward direction. In order for this to occur, a sum of all of the forces acting on the back plate 302 must be a positive value. In other words, a sum of the positive-acting forces $F_1$ and $F_2$ ($F_{1+2}$) must be greater than a sum of the negative-acting forces $F_3$ and $F_4$ ($F_{3+4}$). The difference between those two values, i.e., the portion of $F_{1+2}$ that is not cancelled by $F_{3+4}$ represents the positive force that biases the cylinder barrel 304 and back plate 302 in the outward direction, and is resisted by an equal reaction force $F_5$ of the roller 330 against the track 327.

The relative magnitudes of the forces $F_{1+2}$ and $F_{3+4}$ can be controlled by selecting the cross-sectional areas of fluid passages of the cylinder barrel and back plate, and the areas of surfaces against which fluid pressure acts, in order to select the value of $F_5$. In this way, the forces acting on the roller and trunnions can be selected so that, for example, the roller exerts a smaller net force on the track and casing, and can be a smaller size and strength than would otherwise be required, or so that the roller exerts a larger net force on the track and casing, to offset a greater portion of the forces borne by the trunnions, so the trunnions can be less massive than is normally required.

The motor 300 described with reference to FIGS. 3-5 is a single-sided motor, i.e., a motor that strokes from a zero stroke angle to a positive stroke angle. In order to reverse the torque applied to the output shaft, the high- and low-pressure fluid sources are switched, which reverses the fluid polarity of the motor, so that high-pressure fluid is on the opposite side if the valve plate, causing the pistons to apply torque in the opposite direction. This is done using switching valves between the motor and the fluid sources. Another well-known design permits pivoting of the yoke in both positive and negative directions. Such motors are commonly referred to as over-center motors. Over-center motors are generally larger than equivalent single-sided motors because the casing must accommodate movement of the yoke in both directions. However they offer some particular advantages. For example, the switching valves are eliminated, so the fluid circuit is less complex. Additionally, energy losses due to fluid pressure drop across switching valves are eliminated. This also simplifies fluid and stroke actuation control. Typically, to reverse the torque in a single sided motor, the motor must first be stroked to zero, then the fluid polarity reversed, then the motor stroked back to a desired angle. If the timing of these steps is not correct, i.e., if the polarity is switched while the motor is at a positive angle, the sudden reverse can be very hard, which can damage drivetrain components, etc. In contrast, in an over-center motor, the direction of torque of the output shaft is reversed simply by moving the motor to a negative stroke angle. U.S. Pat. No. 4,991,492 discloses one example of an over-center motor, and is incorporated herein by reference, in its entirety.

Figure 8:
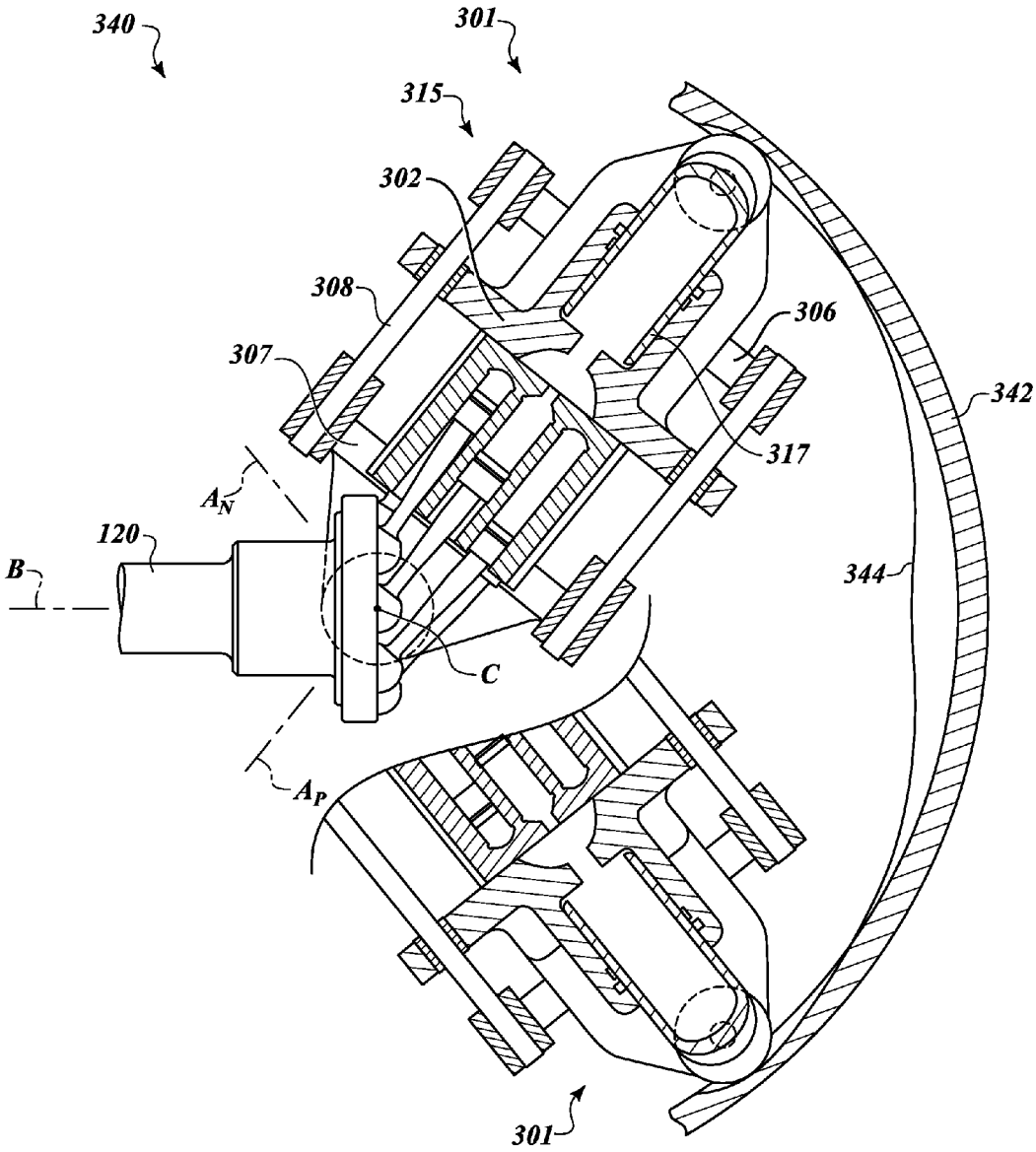
FIG. 8 shows a hydraulic motor according to another embodiment, in a partial cross-sectional view that corresponds to the view of FIGS. 4 and 5.

FIG. 8 shows an over-center motor 340 according to one embodiment, in a view that corresponds to the views of the motor 300 of FIGS. 4 and 5. The motor 340 includes a track 344 located on a section of a motor casing 342. The track 344 has a profile that, above axis B, as viewed in the drawing, is substantially identical to the profile of the track 327 of the embodiment of FIG. 4, and below axis B is substantially a mirror image of the profile of track 327. In other respects, the elements shown are substantially identical to elements previously described with reference to the motor 300, and are therefore indicated by identical reference numbers. The back plate 302 of the motor 340 is shown at a maximum positive stroke angle, at which angle axis A is designated $A_P$, and, in a partial view, at a maximum negative stroke angle, at which angle axis A is designated $A_N$.

As with the track 327 of the embodiment described with reference to FIGS. 3-5, the profile of the track 344 is selected to minimize the unswept volume between the outer limits of travel of each piston and the outer ends of the respective cylinders, of the cylinder barrel associated with the motor 340, but in the case of the motor 340, track 344 is substantially symmetrical and centered at axis B, permitting the motor to be stroked over center. In this way, torque can be selectively applied to the output shaft 120 in either a clockwise or counterclockwise direction without the need to change the polarity of the fluid supply 340. The motor can likewise be switched between a pump mode and a motor mode. In other respects, operation of the motor 340 is substantially identical to the operation of the motor 300 described with reference to FIGS. 3-5.

Figure 9:
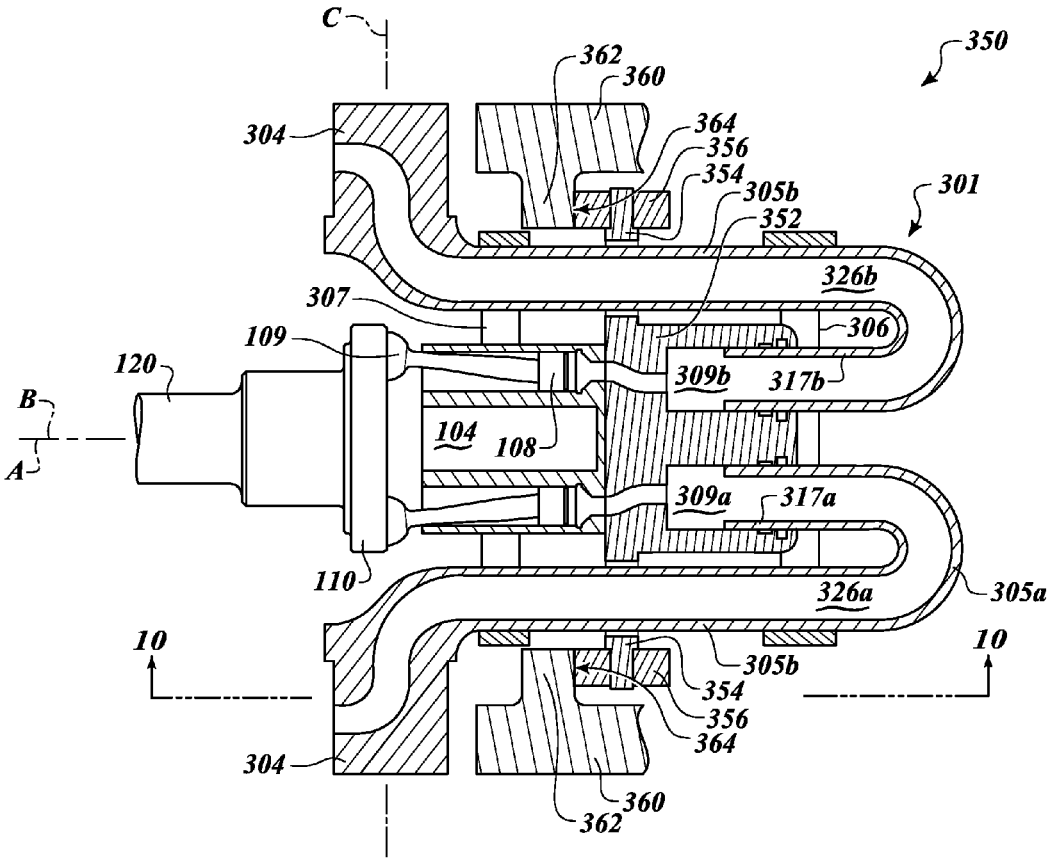
FIG. 9 shows selected elements of a hydraulic motor according to another embodiment, in a partial cross-sectional view that corresponds to the view of FIG. 3.
Figure 10:
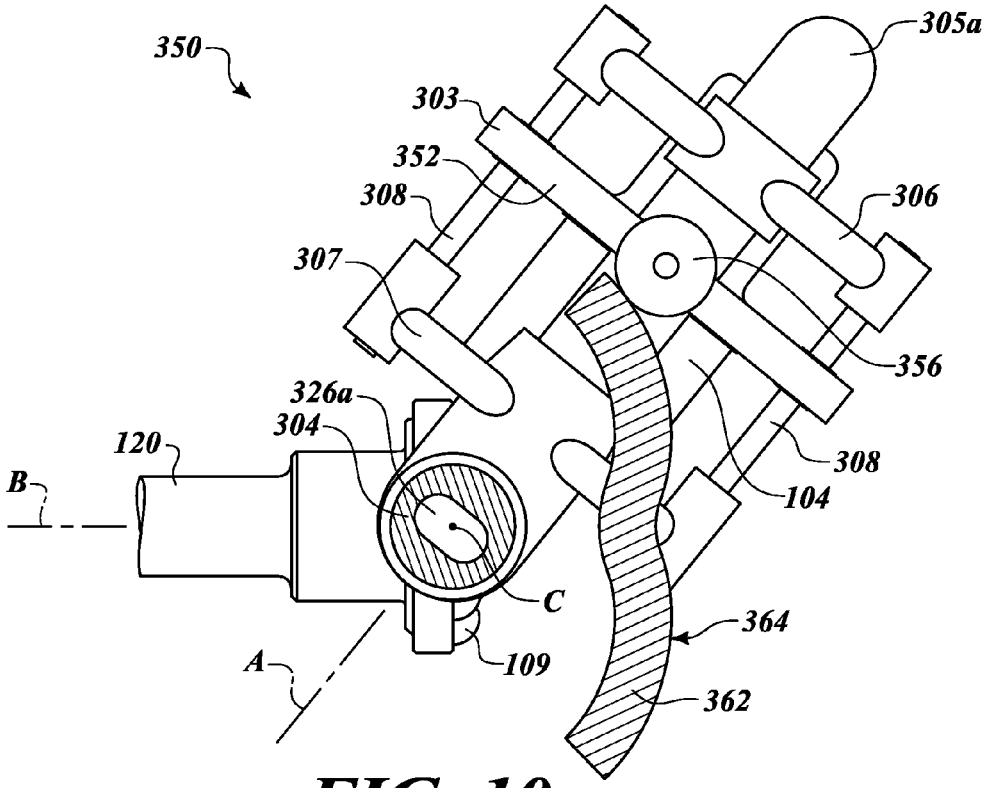
FIG. 10 shows the hydraulic motor of FIG. 9 in a sectional view taken along lines 10-10 of FIG. 9.
Figure 11:
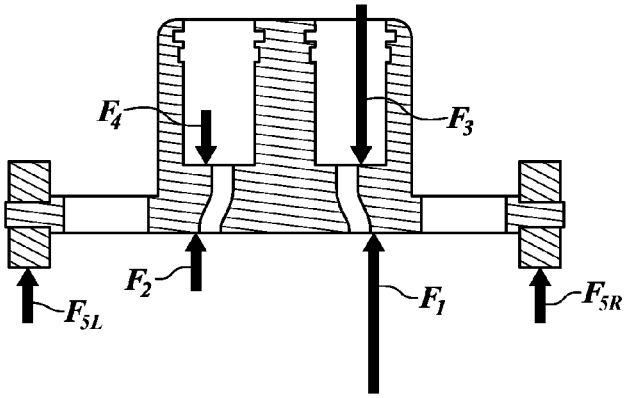
FIG. 11 shows a back plate of the hydraulic motor of FIG. 9, illustrating hydrostatic forces acting thereon.

Turning now to FIGS. 9-11, a motor 350 is shown, according to another embodiment. FIG. 9 shows a partial cross-sectional view taken along a plane defined by axes B and C, similar to the view of FIG. 3, and FIG. 10 shows the motor 350 in a side, partial cross-sectional view taken along lines 10-10 of FIG. 9. The motor 350 is shown from the same direction as the motor 300 in FIG. 5, and at a similar maximum stroke angle, but because the sectional view is taken from a more lateral position, interior components of the motor 350 are not visible. However, the motors 300 and 350 are substantially identical, except as explained below.

The motor 350 comprises a back plate 352 that includes roller arms 354 extending from the back plate toward the sides of the motor along an axis that lies parallel to axis C. Rollers 356 are rotatably coupled to respective ends of the roller arms 354. A track structure 362 is rigidly coupled to an inner surface of a motor casing 360 and includes a track 364 upon which the rollers 356 travel. As discussed in more detail later, the back plate 352 is configured so that the net force of fluid pressures acting on the back plate and cylinder barrel 104 biases the back plate and cylinder barrel in an inward direction along axis A, i.e., downward, as viewed in FIG. 9. Thus, the rollers 356 are biased against the track 364 during operation of the motor 350.

As the yoke 301 pivots about axis C, negative net forces exerted by pressurized fluid compel the rollers 356 to maintain contact with the track 364. Accordingly, the stroke angle of the motor 350 is controlled by the profile of the track 364, as the rollers 356 move along the track. As the stroke angle changes, the distance between the back plate 352 and the axis C varies in a manner similar to that described with reference to the motor 300 of FIGS. 3-6.

FIG. 11 illustrates the principal forces acting on the back plate 352 during operation of the motor 350. As described above with reference to the back plate 302, the net force acting to bias the back plate 352 is determined by the relative values of outwardly acting positive forces $F_1$ and $F_2$, and inwardly acting negative forces $F_3$ and $F_4$. Accordingly, in order for the rollers 356 to bear against the tracks 364, the sum $F_{3+4}$ is selected to exceed $F_{1+2}$ under all conditions. The result is a net inwardly acting force that is resisted by an equal reaction force $F_5$, which in the embodiment shown is divided into two components, $F_{5L}$ and $F_{5R}$, acting against respective ones of the rollers 356. As previously described, the relative values of these forces can be selected, for example, by design specification of the cross sectional areas of the high and low pressure ports 309*a*, 309*b*.

There are a number of advantages associated with the embodiment of FIGS. 9 and 10, as compared to previous embodiments. For example, because the roller reaction forces are now located at two positions that are widely separated, laterally, from the center of the device, the moment arms of the roller reaction forces are larger, thereby providing an improved resolution of net forces and moments within the device. Second, by positioning the track and roller at the sides of the motor instead of further out along axis A, as in previous embodiments, the components of the motor can be more compactly arranged. In addition, in this configuration the direction of the reaction force between the track and roller is reversed, providing an opportunity to resolve internal forces in a way that might be more convenient to a specific implementation of the invention.

Finally, the motor 350 of FIGS. 9-11 will behave in a manner that, in many applications, is inherently safer, in the event that a stroke actuation mechanism should fail. Any yoke-based pump/motor design requires an actuation mechanism to move the yoke to a desired stroke angle. The actuator 332 shown diagrammatically in FIGS. 4 and 5 is one example, and many other examples of means for controlling the stroke angle are described or shown in references mentioned elsewhere in this disclosure and incorporated herein. If the actuator mechanism of a motor were to fail while the fluid supply to the motor remained uninterrupted, the motor would continue producing torque, with no inherent means for a quick shutdown. Thus, in applications where life and safety are at risk, means should be provided to move the stroke angle automatically to a zero stroke angle.

For variable length pump/motors of the general type disclosed herein, if a stroke angle actuation control force is absent, the roller reaction force $F_5$ becomes the dominant force driving the stroke angle. The roller reaction force $F_5$ is exerted in a direction normal to the surface of the track at the point where the roller contacts the track. If the surface of the track is not perpendicular to the axis A at that point, the force $F_5$ resolves into an axial force component along axis A, and a radial force component that is perpendicular to the axial force component and toward the normal force. In other words, a "downhill" force is applied that will tend to pivot the yoke in the direction that will permit the back plate to move axially in the direction urged by the net fluid pressures acting on the back plate. In the case of the embodiments described with reference to FIGS. 3-8, the downhill force will be in a direction that increases the stroke angle, so a failure of the actuator 322 of FIG. 4 could result in the motor 300 moving directly to the maximum stroke angle of FIG. 5.

On the other hand, with regard to the motor 350 described with reference to FIGS. 9-11, the downhill force will be in a direction that decreases the stroke angle. Thus, in response to a similar actuator failure, the motor 350 would tend to move toward the zero angle position.

Figure 12A:
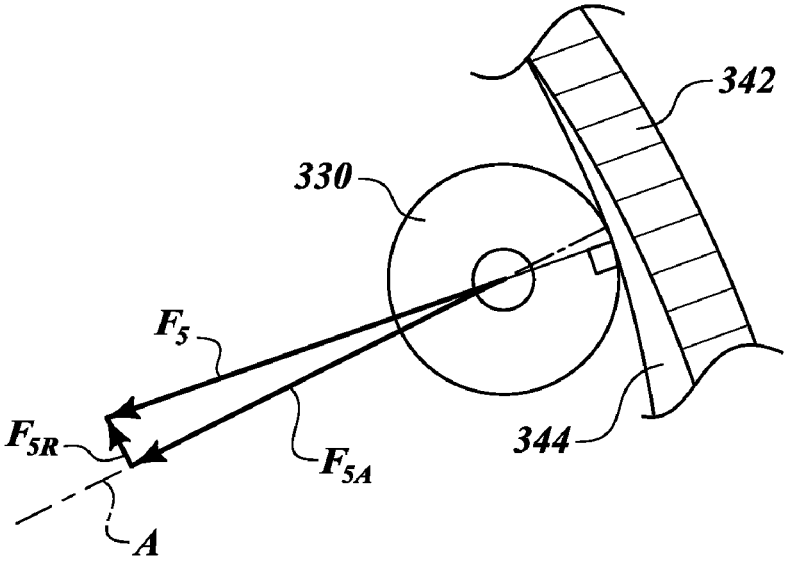
FIGS. 12A and 12B illustrate the resolution of forces acting to affect stroke angle of hydraulic motors according to various embodiments.

The direction in which the roller bears against the track determines the direction of this downhill stroking force. FIG. 12A illustrates the forces at work on the motor 340 of FIG. 8. The roller 330 is shown against the track 344 at a moderate stroke angle. The roller is biased outwardly along axis A by pressurized fluid acting on the back plate 302. Because axis A is not perpendicular to the track at this point, the reaction force $F_5$ is not coincident with axis A, but extends normal to the track surface. The roller reaction force $F_5$ resolves into axial force $F_{5A}$ and radial force $F_{5R}$, which points in a direction of increasing displacement. Loss of actuation control will therefore tend to stroke the motor toward a maximum displacement angle. This undesirable failure mode can be prevented but requires additional complexity in the hydraulic circuit and control system.

Figure 12B:
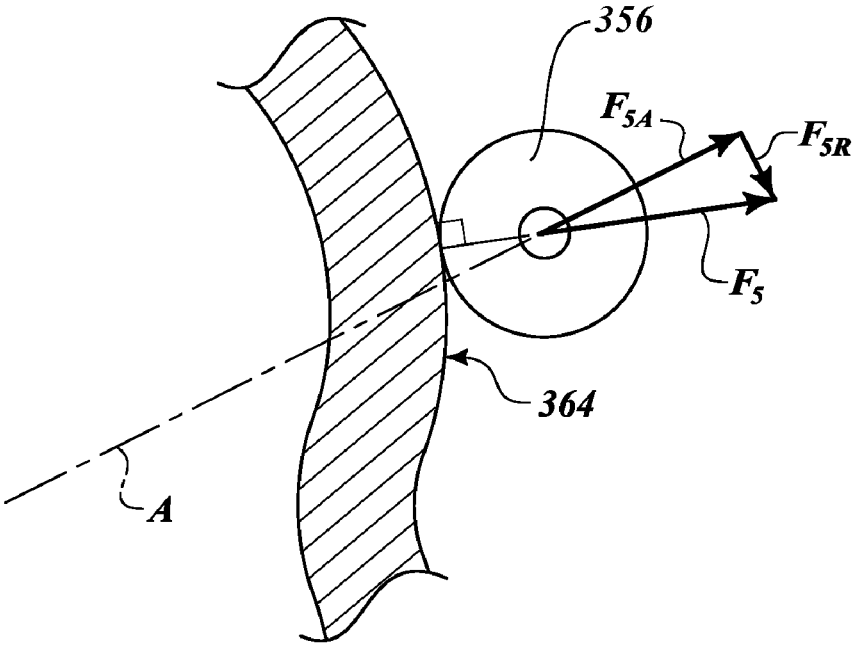

In contrast, FIG. 12B illustrates the forces at work on the motor 350 of FIGS. 9 and 10. The roller 356 is shown against the track 364. The roller is biased inwardly along axis A by fluid acting on the drive plate 352. Again, axis A is not perpendicular to the track at this point. Here, the roller reaction force $F_5$ resolves into axial force $F_{5A}$ and radial force $F_{5R}$, which points in a direction of decreasing displacement. Loss of actuation control will therefore cause the motor to naturally seek a neutral position at a small or zero displacement, thereby providing an inherent safety feature.

The motor 350 of FIG. 10 is shown as an over-center motor. However, according to an alternate embodiment, a single-sided motor is provided, that operates under similar principles.

According to another alternative embodiment, a track structure similar to the track structure 362 of FIG. 10 is provided, with a track on an inwardly facing surface, and fluid pressures are selected to provide a net outward bias to the back plate. Thus, rather than inwardly, as described with reference to the motor 350 the rollers bear outwardly against the track. While the motor of this embodiment will not tend to move to a lower stroke angle under the failure condition discussed above, it does still provide the benefit of a more compact design than the embodiments of FIGS. 3-8. Additionally, the reaction forces are distributed between two rollers, and to two widely separate portions of the motor casing. Thus, in some applications it may be practical to distribute a larger portion of the fluid-generated forces to the casing via the rollers and tracks, thereby reducing the forces acting on the trunnions.

Figure 13:
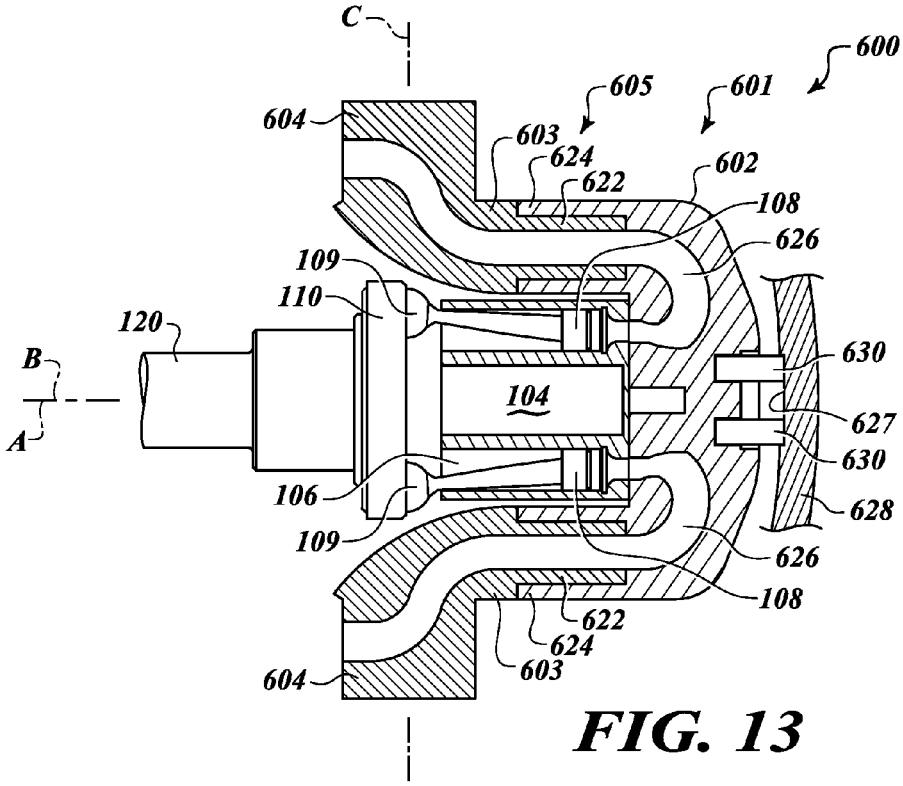
FIG. 13 shows selected elements of a hydraulic motor, according to another embodiment, in a partial sectional view that corresponds to the view of the motor of FIG. 3.

FIG. 13 shows, according to another embodiment, elements of a bent-axis pump/motor 600 in a partial sectional view taken along a plane defined by the axes B and C. Axis A also lies in the same plane while the motor 600 is at a zero stroke angle, as shown. In addition to the drive plate 110, the output shaft 120, the cylinder barrel 104, and the pistons 108, the motor 600 comprises a yoke 601 that includes a back plate 602, yoke legs 605, and trunnions 604. The yoke legs 605 include inner leg sections 622 coupled to respective lower legs 603 and the trunnions 604, and outer leg sections 624 coupled to the back plate 602. Each inner leg section 622 is received in a respective outer leg section 624 so as to permit telescoping of the yoke legs 605 while providing sealed passages 626 to transmit hydraulic fluid to and from the cylinders 106 of the cylinder barrel 104. The back plate 602 is provided with a roller 630 that engages a track 627 located on an inner surface of a motor casing 628, a portion of which is shown in FIG. 13. The roller 630 is shown in FIG. 13 as a pair of rollers rotatable on a common axis. Alternatively, the roller 630 can comprise a larger number of individual rollers, or only one, according to the design considerations of a particular application. For example, use of multiple rollers rotating on common or different axes could assist in distributing reaction forces between the casing and the rollers across multiple locations instead of only one in order to better resolve internal forces within the device.

The outer leg sections 624 telescope over the inner leg sections 622 to permit the yoke legs to change length as the stroke angle changes. In much the same manner as described with reference to previous embodiments, as the stroke angle increases, the distance along axis A between drive plate 110 and track 627 increases, allowing fluid pressure within the cylinder barrel 104 and the yoke legs 605 to result in extension of the yoke legs 605, increasing the distance between drive plate 110 and cylinder barrel 104. Conversely, as the stroke angle decreases toward zero, the distance along axis A decreases, forcing the yoke legs 605 to telescope and shorten, moving the back plate 602 and the cylinder barrel 104 inward along axis A and reducing the distance between the drive plate and the cylinder barrel. The profile of the track 627 is selected to reduce or substantially eliminate the unswept volume between the outer limits of each piston 108 and the outer ends of the cylinders 106, thereby reducing or eliminating fluid compression losses that otherwise occur in the unswept volume of the cylinders.

Figure 14:
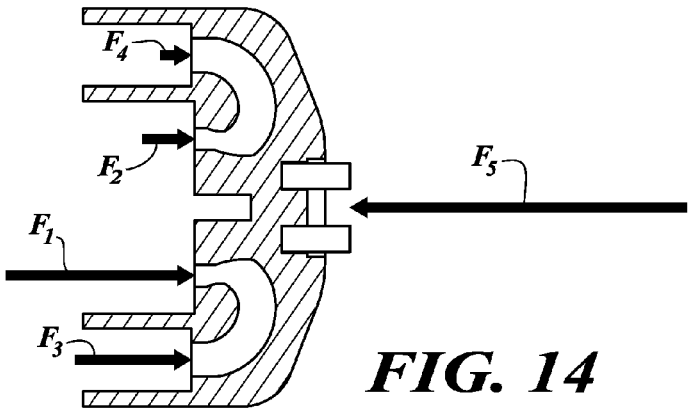
FIG. 14 shows a back plate of the hydraulic motor of FIG. 13, illustrating hydrostatic forces acting thereon.

A particular concern in the design of any motor is the need for resolving internal forces within the device in order to reduce the potential for wear and minimize the necessary strength and stiffness, and therefore weight, size, and cost of the device. FIG. 14 illustrates some of the forces generated by fluid pressures within the motor 600 of FIG. 13. Fluid pressures acting on surfaces within the telescoping junctions of the yoke legs 605 produce positive forces $F_3$ and $F_4$, that bias the back plate 602 in an outward direction. Likewise, barrel forces $F_1$ and $F_2$ also bias the back plate 602 in the outward direction. Thus, there are no cancelling forces, and the net biasing force is substantially equal to a sum of all of the forces $F_1$, $F_2$, $F_3$, and $F_4$, which is exerted by the roller 630 onto the track 627. This is in contrast to the configurations of previous embodiments, in which forces $F_3$ and $F_4$ act in opposition to, and largely counteract forces $F_1$ and $F_2$, resulting in smaller roller reaction forces.

On the other hand, in the configuration of the embodiment of FIGS. 13 and 14, nearly all of the pressure-generated forces are borne by the casing, while the forces acting on the trunnion are substantially eliminated or even reversed. In many applications, the increased reaction force on the casing may be treated simply by specifying a sufficiently strong roller and casing structure.

According to an alternate embodiment, rollers are coupled to the sides of the back plate 602 in a manner similar to that described with reference to FIGS. 9 and 10, and track structures are provided on inner surfaces of the motor casing at the sides, with tracks positioned in the inwardly facing surface. In this way, the increased reaction forces, as compared to the embodiments of FIGS. 3-8, are distributed to two sides of the casing rather than across the center of the back of the casing.

Figure 15:
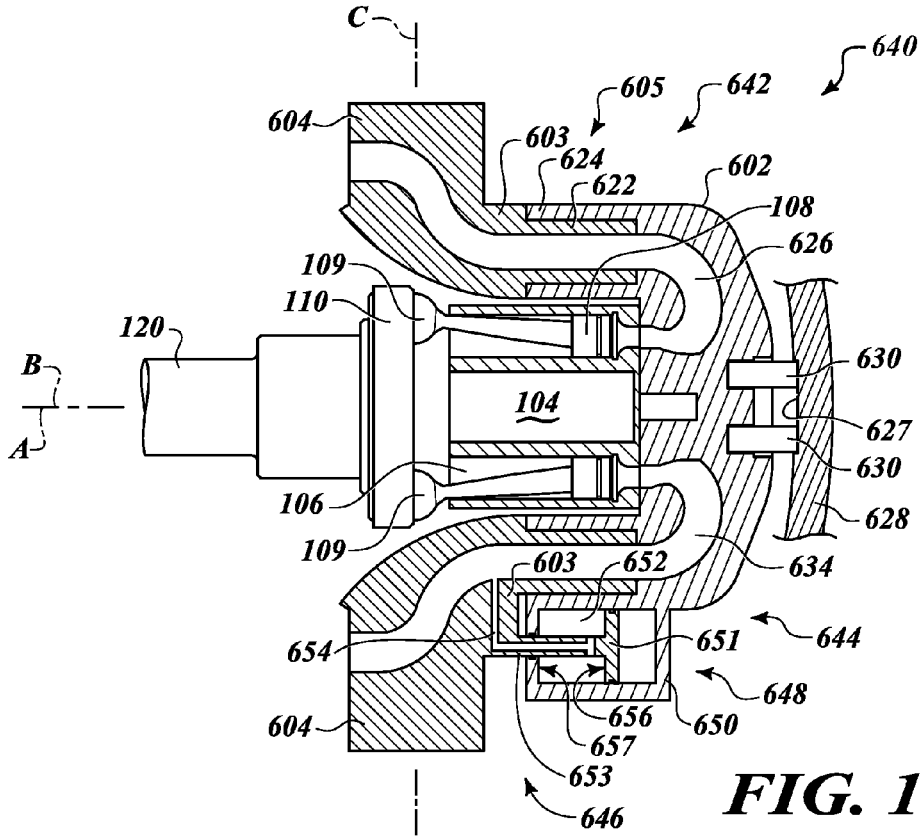
FIG. 15 shows a hydraulic motor according to another embodiment, in a partial cross-sectional view that corresponds to the view of the motor of FIG. 13.

FIG. 15 depicts a motor 640 according to another alternate embodiment, in which a hydrostatic counterbalance mechanism is provided, to reduce the roller reaction force. The motor 640 comprises a yoke 642 that includes an upper yoke leg 644 and a lower yoke leg 646. The upper yoke leg 644 includes a hydrostatic counterbalancing cylinder 648 that is coupled to the upper yoke leg on a high pressure side of the yoke 642 so as to counteract separation forces produced within the telescoping junction of the yoke. The counterbalancing cylinder 648 includes a cylinder body 650 which defines a cylinder bore 652 that includes a first working surface 657. A piston 651 is coupled, via a piston rod 653, to the lower yoke leg 646, and includes a second working surface 656. The piston rod 653 and piston 651 are positioned, in a slideable and sealed arrangement, within the cylinder bore 652. Pressurized fluid from a fluid passage 634 of the yoke 642 is placed in fluid communication with the cylinder bore 652 via a flow-through passage 654.

During operation of the motor 640, fluid pressure from the fluid passage 634 is transmitted to the cylinder bore 652 via the flow-through passage 654, where it exerts a hydrostatic force on the first working surface 657 in an inward direction, opposite that of the separation forces of the telescoping junctions of the yoke legs, thereby reducing the force transmitted to the casing by the roller. Meanwhile, fluid pressure acting on the second working surface 656 generates an outward-acting force, equal to the force exerted on the first working surface 657, that is transmitted to the trunnion 604 by the piston rod 653. In this way, a portion of the reaction force F5 is distributed to the trunnion.

Figure 16:
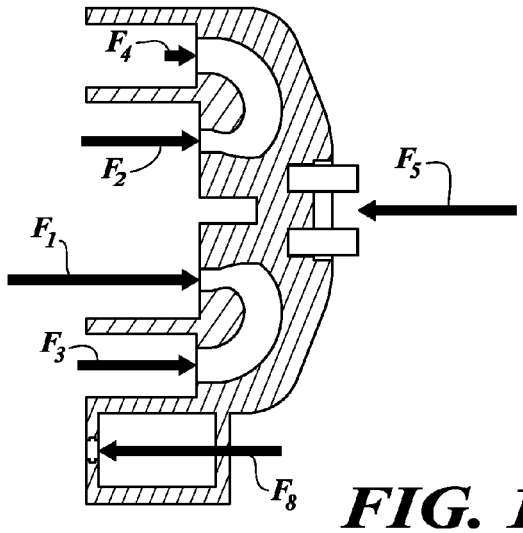
FIG. 16 shows a back plate of the hydraulic motor of FIG. 15, illustrating hydrostatic forces acting thereon.

The area of the first and second working surfaces 657, 656 is selected according to a desired distribution of forces between the trunnion and the roller. FIG. 16 shows an example of the force resolution according to this embodiment. $F_8$ represents the negative force exerted by the counterbalancing cylinder 648, which now at least partly counteracts the positive forces $F_1$-$F_4$, resulting in a smaller roller reaction force $F_5$.

In FIG. 15, a single counterbalance piston and cylinder mechanism 648 is positioned on the high pressure leg of the yoke 642. According to an alternative embodiment, a second counterbalance mechanism is similarly positioned on the low pressure leg of the yoke. As is known in the art, the magnitude of a pressure generated force is a function of the fluid pressure and the surface area against which it acts. Thus, assuming that the areas of the working surfaces of the counterbalance mechanisms are equal, a ratio of the counterbalancing forces produced on the high- and low-pressure sides will be equal to the ratio of the fluid pressures of the high- and low-pressure fluid sources. In some applications, this ratio may be ideal for balancing the disparate forces generated on the respective sides of the motor. In other cases, it may be desirable to provide a motor in which forces generated do not correspond, in a relative sense, to the respective values of the high- and low-pressure sources. In such a case, the areas of the working surfaces of the respective mechanisms can be selected accordingly.

Even in cases where it is not essential to provide counterbalancing forces on the low-pressure side of a motor, such an arrangement provides another advantage. If the motor is to be operated in forward and reverse directions by switching polarity, a second counterbalance piston and cylinder mechanism coupled to the opposite yoke leg would serve to balance the reaction forces while the motor operates in reverse.

Figure 17A:
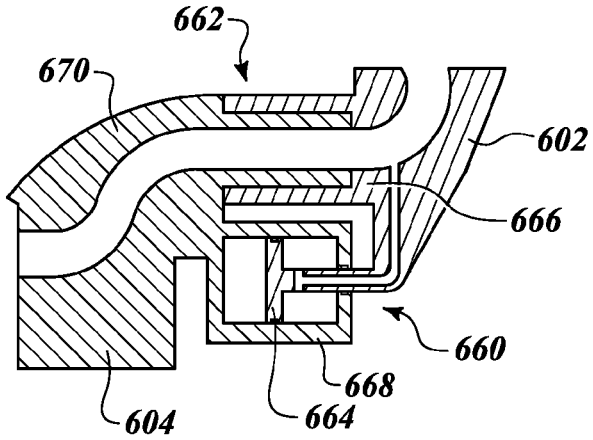
FIGS. 17A-17C show respective alternative configurations of the embodiment of FIG. 15.
Figure 17B:
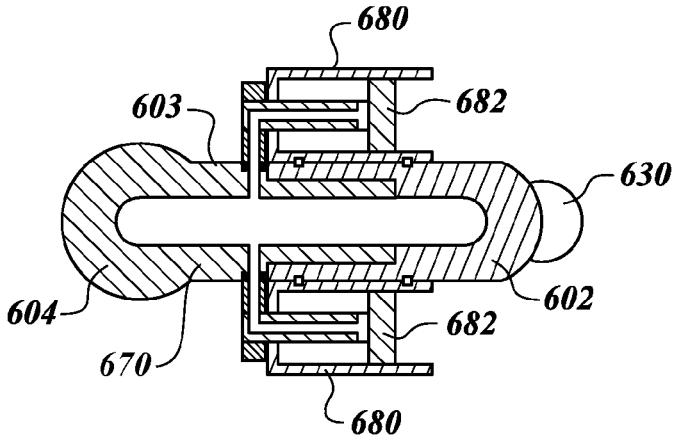
Figure 17C:
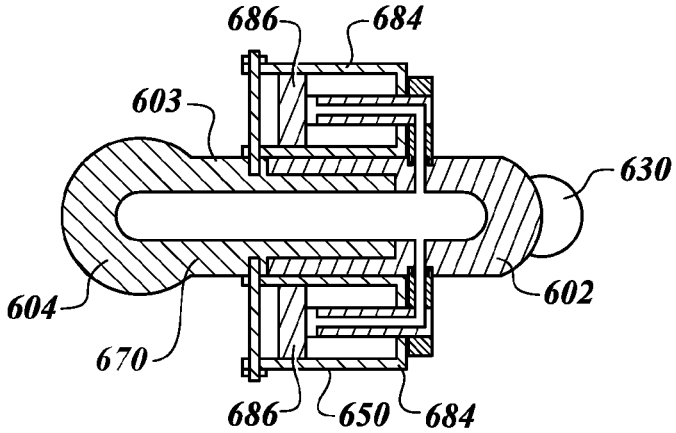

FIGS. 17A-17C show respective alternative embodiments.

FIG. 15 depicts piston 651 and rod 653 as being connected to the lower leg section 603, and the cylinder body 650 as being connected to the upper leg section 602. According to an alternate embodiment, the same hydrostatic balancing force is achieved by reversing the arrangement. As shown in FIG. 17A, a counterbalancing cylinder 660 is provided, coupled to a yoke leg 662 of a motor that is otherwise substantially similar to the motor 600 of FIG. 13. A piston 664 is coupled to an upper yoke leg 666, and a cylinder body 668 is coupled to a lower yoke leg section 670.

FIG. 15 depicts the cylinder 650 and the piston 651 as being integral to the upper and lower yoke legs 644, 646. However, the same function can be achieved by other means, such as, for example, coupling one or multiple separately produced cylinder bodies and piston mechanisms to the yoke legs employing fasteners such as, e.g., bolts or pins. FIG. 17B shows a pair of cylinder bodies 680 coupled to a yoke leg section 602 of a yoke, and a corresponding pair of pistons 682 coupled to lower yoke leg 670.

FIG. 17C shows a pair of cylinder bodies 684 coupled to a lower yoke leg 670, and a corresponding pair of pistons 686 coupled to a yoke leg section 602 of a yoke.

Figure 18:
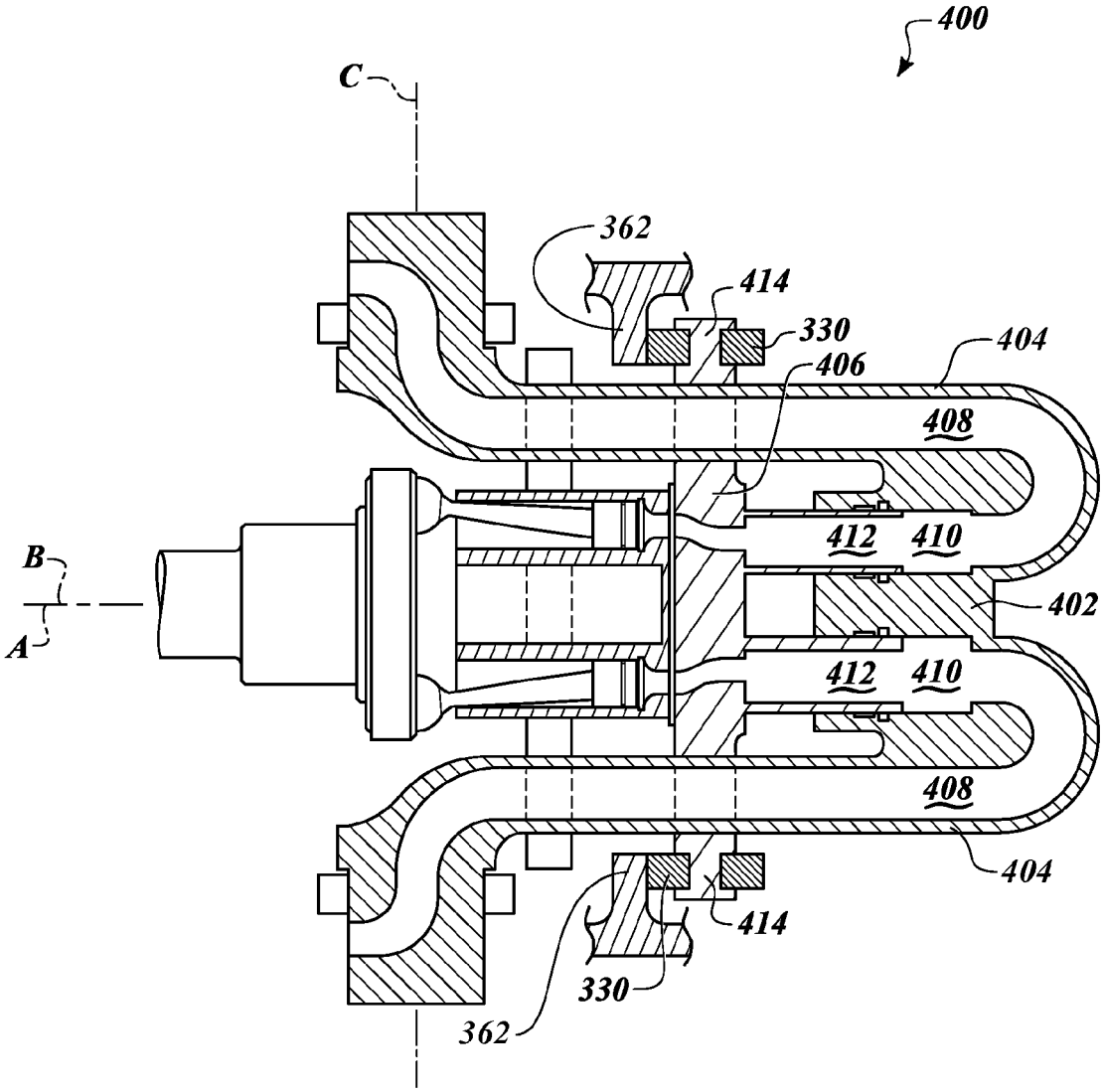
FIG. 18 shows an example of a hydraulic motor according to another embodiment, in a view that corresponds to the view of FIG. 3.

The embodiments of FIGS. 3-11 are shown as having female junction ports on the back plate, which receive male connections at the second ends of the yoke legs. FIG. 18 shows a motor 400 according to an alternate embodiment. The motor 400 includes a top structure plate 402 that incorporates first and second yoke legs 404, and a back plate 406. The first and second yoke legs each comprise a fluid passage 408 extending therein, and a respective female connector 410. The back plate 406 includes first and second fluid ports 412 configured to be received in respective ones of the female connectors 410 to form a slidable coupling, which functions in a manner similar to the slidable couplings described with reference to other disclosed embodiments. The back plate 406 also includes roller arms 414, to which are coupled respective rollers 330, that engage a track structure 362, as previously described.

The motor 400 operates in a manner similar to that of the motor 350, as described with reference to FIGS. 9-11. The back plate is configured to generate a net negative force, to bias the rollers 330 against the track structure 362.

Figure 19:
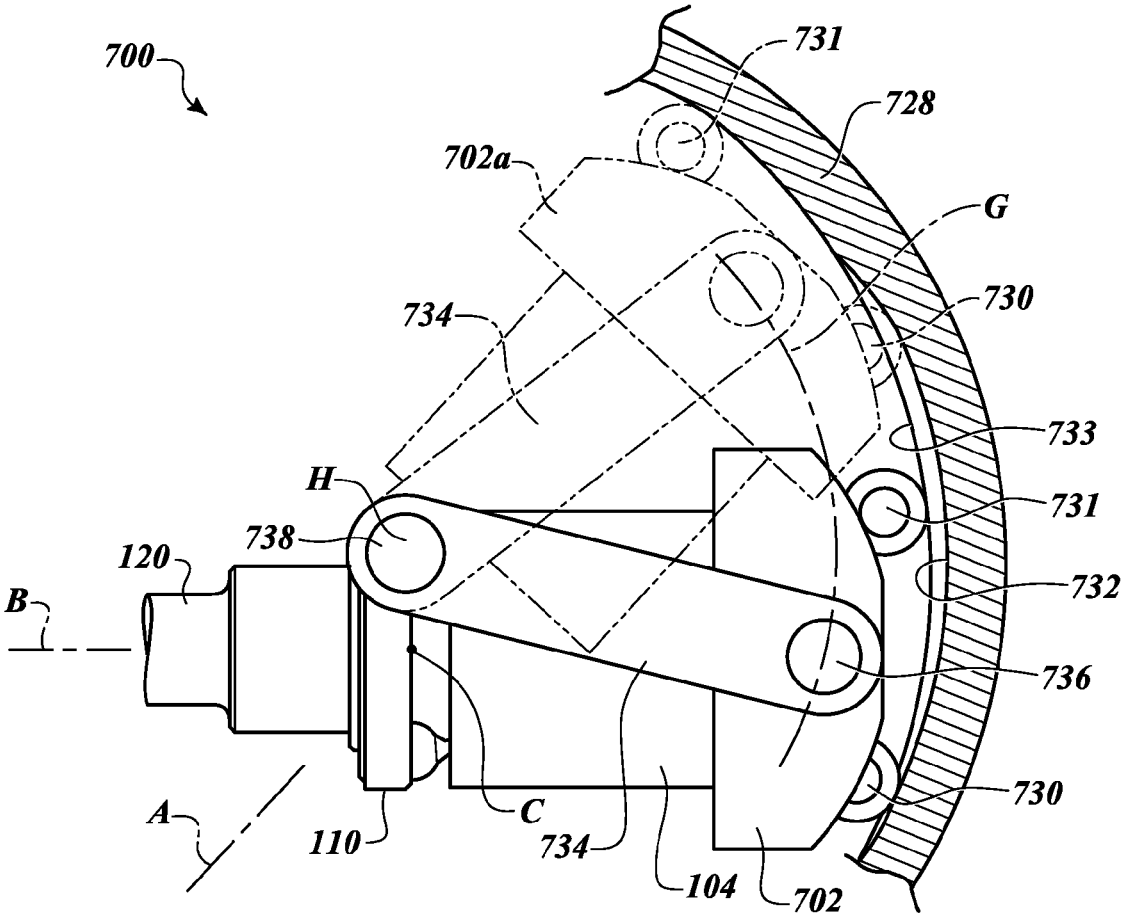
FIG. 19 shows a hydraulic motor according to another embodiment.

Turning now to FIG. 19, motor 700 is shown, according to another embodiment, in a side view similar to the view of motor 300 in FIG. 4. Motor 700, shown in solid lines at a minimum stroke angle and in phantom lines at a maximum stroke angle (with the back plate designated 702*a*), comprises back plate 702, cylinder barrel 104, pistons in respective cylinders of cylinder barrel 104, drive plate 110, and output shaft 120, substantially as described above with reference to previous embodiments. Back plate 702 comprises first and second rollers or sets of rollers 730, 731, each engaging a respective one of first and second tracks 732, 733 positioned on a section of motor casing 728. Fluid linkage members 734 are positioned on opposite sides of back plate 702, and are pivotably coupled at respective first ends 736 to back plate 702 and at second ends 738 to fluid coupling points in the motor casing. Fluid is transmitted between high- and low-pressure fluid sources and the back plate via fluid channels in fluid linkage members 734. With the exception of the portion of casing 728 that comprises the first and second tracks 732, 733, the motor casing of motor 700, including the fluid coupling points to which the second ends of the fluid linkage members 734 are coupled, is not shown in FIG. 19. However, there are many such structures that are well known in the art, and it is within the abilities of one of ordinary skill to select and adapt an appropriate structure to serve as a fluid coupling point.

The profiles of first and second tracks 732, 733 are selected to cooperate, respectively, with first and second rollers 730, 731 to control the distance of back plate 702 and cylinder barrel 104 from drive plate 110 to minimize the unswept volume of the cylinders of cylinder barrel 110. Additionally, first and second rollers 730, 731 and respective tracks 732, 733 cooperate to control the orientation of back plate 702 and cylinder barrel 104 with respect to drive plate 110 to maintain alignment of the cylinder barrel so that axes A and B intersect at axis C at any stroke angle. As the stroke angle of motor 700 changes, first ends 736 of fluid linkage members 734 follow arc G. Second ends 738 are coupled to the casing at axis H, which lies at the center of arc G, such that fluid linkage members 734 pivot around axis H as the stroke angle changes. Because axis H is not coaxial with axis C, fluid linkage members 734 also pivot around their couplings with back plate 702 as the stroke angle changes.

In contrast to other embodiments described, the embodiment of FIG. 19 provides for variable length operation without the need for a variable length fluid supply.

The embodiments heretofore described have each been illustrated as having a high-pressure fluid supply and a low-pressure fluid supply occupying separate legs of a two-legged yoke. It is well known in the art that the need for a separate low-pressure fluid supply in a leg of a yoke-based bent-axis machine can be obviated by use of a dedicated wet case, in which a space within the motor casing not occupied by motor components is occupied by fluid in communication with the low-pressure reservoir. According to this practice the casing effectively becomes a part of the low-pressure reservoir and so separate passages to conduct low-pressure fluid in and out of the motor are not required. Embodiments that have been described as having a two-legged yoke with high- and low-pressure passages can be modified to employ a single-legged yoke with a single high-pressure fluid carrying leg. The embodiments are therefore not limited to configurations that employ both low-pressure and high-pressure variable length supply means.

According to various embodiments, a track in which a roller travels is described as being located on an inner surface of the casing. This language is not to be construed as limiting the structure of the track, or the way in which the track is provided. As used in the claims, track is to be construed as encompassing within its scope any configuration or surface that serves to facilitate low-friction movement of a contacting means along its surface, and can be as simple as a relatively smooth inner surface of the casing. Other examples of a track and contacting means include a channel recessed into the surface of the casing, a berm-like structure raised above the surface, a V-shaped groove configured to receive a correspondingly shaped roller, a series of transverse notches that are engaged by gear-like teeth on a roller, a gondola-like structure allowing contact to be maintained in tension rather than compression, and a slot forming two bearing surfaces between which a contacting structure may be axially restrained to maintain contact in both compression and tension. Additionally, the track can be formed from the same material as the casing, such as by casting or machining, or can be manufactured separately and applied to a surface of the casing. Furthermore, the term roller is to be construed as comprising within its scope any structure that serves to reduce or eliminate friction between elements, as one element moves across a surface of another element, particularly in the case where a force is present that biases the one element toward the other. Examples include the roller structures disclosed herein, and additionally, ball bearings, fluid bearings, bronze bushings, plastic bushings, low-friction surface coatings, etc.

A number of advantages are provided according to various embodiments. For example, by minimizing the unswept volume of the cylinders, efficiency losses are reduced, especially when a motor is operating at a small stroke angle. This also reduces the strength of the pulses that occur as each cylinder crosses between the high- and low-pressure sides of the valve plate, which reduces noise and vibration. Because the amount of unswept volume at a given stroke angle is controlled by the profile of the track, which can describe any continuous profile, the amount of unswept volume remaining in the cylinders can be made to vary with the stroke angle, which affords the possibility of fine tuning the unswept volume at different ranges of operation. For example, in practical applications the objective of noise reduction might need to be balanced with other objectives such as flow optimization or mechanical clearance, which might be served by allowing for a different unswept volume at some ranges of stroke angle than at others.

Additionally, by utilizing a track means and a contacting means (such as a roller and track surface) to transfer reaction forces to the casing, the size, mass, and weight of the yoke legs, trunnions, and coupling points of the casing may be reduced. Because of advantages inherent in the curved shape of the casing, the commensurate strengthening of the casing in the region where the rollers travel requires less added material, and is simpler and less prone to failure than prior art yoke-and-trunnion motors, resulting in an overall reduction in size and weight and an increase in reliability of the motor.

The known prior art that is directed toward a variable length hydraulic machine utilizes an off-center pivot around which the back plate and cylinder barrel pivot. Such motors are not capable of over-center operation, because one side of the pivoting structure is rigidly fixed. Furthermore, the maximum angle of pivot is potentially limited by geometric interference such as piston rod contact with the cylinder barrel.

Many elements of bent-axis machines that are well known in the art but are not necessary for an understanding of the principles of the invention are omitted from the drawings and description to avoid unnecessary complexity and reduce the likelihood of confusion. Such omitted elements include, for example, static and active seals, axial and radial bearings, valves, actuators, fluid transmission lines, etc. All such elements are familiar to those of ordinary skill in the art.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

Elements of the various embodiments described above can be combined, and further modifications can be made, to provide further embodiments without deviating from the spirit and scope of the invention. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

I claim:

1. A hydraulic machine, comprising:

a drive plate and power shaft configured to rotate about a first axis;

a cylinder barrel configured to rotate about a second axis, the cylinder barrel having a plurality of cylinders and a corresponding plurality of pistons positioned therein, each bearing against the drive plate, the first and second axes intersecting at a third axis that lies perpendicular to the first and second axes;

a back plate supporting the cylinder barrel and including a valve surface over which the cylinder barrel rotates;

angle control means for controlling an angle of the second axis relative to the first axis; and axial position control means for controlling a distance, along the second axis, of the cylinder barrel from the third axis, such that the distance between the third axis and the cylinder barrel varies as the cylinder barrel travels along the second axis.

2. The machine of claim 1 wherein the axial position control means controls translation of the back plate along the second axis so as to control a distance between the cylinder barrel and the third axis.

3. The machine of claim 1, comprising a fluid channel that is coupled to the back plate via a telescoping junction and that accommodates translation of the back plate along the second axis while maintaining fluid communication of the back plate with a source of pressurized fluid.

4. The machine of claim 1 wherein the angle control means includes a yoke that is pivotable around the third axis, and to which the back plate is coupled.

5. The machine of claim 4 wherein the yoke includes a fluid channel that extends in a leg of the yoke and is coupled to the back plate via a telescoping junction that accommodates translation of the back plate along the second axis while maintaining fluid communication of the back plate with a source of pressurized fluid.

6. The machine of claim 4, further comprising a hydrostatic counterbalancing mechanism that includes:

a cylinder bore in fluid communication with a source of pressurized fluid, and including a first working surface; and a piston positioned within the cylinder bore and including a second working surface;

the counterbalancing mechanism being operatively coupled to the back plate and configured such that fluid pressure acting on the first and second working surfaces reduces a net hydrostatic force acting on the back plate.

7. The machine of claim 1 wherein the angle control means includes means for changing the angle of the second axis to positive angles and to negative angles relative to the first axis.

8. The machine of claim 1 wherein the axial position control means controls the distance between the cylinder barrel and the third axis so that the distance is reduced as the angle of the second axis relative to the first axis is reduced, and increased as the angle is increased.

9. The machine of claim 1 wherein the axial position control means includes a track coupled to an inner surface of a casing of the machine, and a roller coupled to the back plate in a position where the roller can engage the track.

10. The machine of claim 9 wherein a profile of the track is selected so that as the angle of the second axis relative to the first axis changes, the distance between the cylinder barrel and the third axis is controlled by movement of the roller along the track.

11. The machine of claim 9 wherein the track comprises a plurality of individual tracks, and the roller comprises a plurality of individual rollers, each configured to engage a respective one of the plurality of individual tracks.

12. The machine of claim 9 wherein the roller is positioned substantially on the second axis.

13. The machine of claim 10 wherein hydrostatic forces acting on surfaces of the machine are selected to produce a net force on the back plate and roller that will tend to bias the roller against the track.

14. The machine of claim 10, comprising a track structure coupled to the casing of the machine, the track extending on a surface of the track structure and facing substantially away from the third axis, and wherein hydrostatic forces acting on surfaces of the machine are selected to produce a net force on the back plate and roller that will tend to bias the roller toward the third axis.

15. A hydraulic machine, comprising:

a rotatable shaft;

a drive plate, rotationally coupled to the shaft, the drive plate and shaft being configured to rotate together about a first axis;

a cylinder barrel, configured to rotate about a second axis that intersects the first axis at a third axis lying perpendicular to the first and second axes, the cylinder barrel having a plurality of cylinders radially distributed therein;

a plurality of pistons, first ends of each being positioned in a respective cylinder of the barrel and second ends of each engaging the drive plate; and a back plate, including a valve surface on which the cylinder barrel rotates, the back plate configured to pivot with the cylinder barrel around the third axis such that an angle of the second axis changes, relative to the first axis, thereby defining a stroke angle, the back plate, further configured to control a distance of the cylinder barrel from the third axis by moving in a direction along the second axis closer to the third axis as the stroke angle decreases and in a direction farther from the third axis as the stroke angle increases, such that the distance between the cylinder barrel and the third axis is variable as the cylinder barrel moves along the second axis.

16. The hydraulic machine of claim 15, further comprising:

a casing;

a track positioned on an interior surface of the casing and extending in a plane substantially parallel to the plane defined by the pivot of the second axis; and a contacting means coupled to the back plate and configured to maintain contact with the track as the stroke angle changes, the track defining a profile that controls the distance of the cylinder barrel from the third axis to a selected distance as a function of the stroke angle.

17. The hydraulic machine of claim 15 wherein the back plate is configured to pivot with the cylinder barrel around the third axis to positive angles and to negative angles.

18. The hydraulic machine of claim 15, further comprising:

a yoke rotatably coupled to the casing and configured to support the back plate and to pivot with the back plate around the third axis, and including:

a fluid passage extending within the yoke and placing the back plate in fluid communication with a source of pressurized fluid;

a telescoping junction configured to accommodate the movement of the back plate along the second axis while maintaining the fluid communication of the back plate with the source of pressurized fluid;

a hydrostatic counterbalancing mechanism that includes:

a cylinder bore in fluid communication with the fluid passage, and including a first working surface; and a piston positioned within the cylinder bore and including a second working surface;

the counterbalancing mechanism being coupled to the yoke and configured to apply a bias in opposition to a separation force produced by fluid pressure in the telescoping junction.

19. The hydraulic machine of claim 15, further comprising:

a casing;

a first track and a second track rigidly supported by the casing;

a first roller and a second roller coupled to the back plate and configured to maintain contact with the first and second tracks, respectively, as the stroke angle changes; the first and second tracks having profiles such that, as the stroke angle changes, the back plate translates longitudinally and maintains alignment with respect to the second axis.

20. The hydraulic machine of claim 19, comprising a link having a first end rotatably coupled to the back plate and a second end rotatably coupled to the casing, the link having, extending therein, a fluid passage that is in fluid communication with the valve plate.

21. A method of establishing the displacement of a variable displacement bent-axis hydraulic machine, comprising:

establishing a stroke angle by pivoting a first axis, around which a cylinder barrel of the machine rotates, relative a second axis, around which a drive plate of the machine rotates, around a point that is common to the first and second axes;

moving, while pivoting the first axis relative to the second axis, the cylinder barrel along the first axis to a preselected total axial distance of the cylinder barrel from the drive plate that is a function of the stroke angle; and modifying, while moving the cylinder barrel along the first axis, a total distance along which a fluid passage transports a working fluid between a fluid source and a valve surface of the cylinder barrel, such that the total distance along which the fluid passage transports the working fluid varies as the cylinder barrel moves along the first axis.

22. The method of claim 21 wherein the preselected total axial distance is a distance that results in an unswept volume of cylinders of the cylinder barrel being a preselected volume as a function of the stroke angle.

23. The method of claim 21 wherein the modifying a total distance comprises telescoping a first segment of a fluid passage within a second segment thereof.

24. A hydraulic machine, comprising:

a drive plate and power shaft configured to rotate about a first axis;

a cylinder barrel configured to rotate about a second axis, the cylinder barrel having a plurality of cylinders and a corresponding plurality of pistons positioned therein, each bearing against the drive plate, the first and second axes intersecting at a third axis that lies perpendicular to the first and second axes;

a back plate supporting the cylinder barrel and including a valve surface over which the cylinder barrel rotates;

angle control means for controlling an angle of the second axis relative to the first axis, the angle control means including a yoke that is pivotable around the third axis, and to which the back plate is coupled, wherein the yoke includes a fluid channel that extends in a leg of the yoke and is coupled to the back plate via a telescoping junction that accommodates translation of the back plate along the second axis while maintaining fluid communication of the back plate with a source of pressurized fluid; and axial position control means for controlling a distance, along the second axis, of the cylinder barrel from the third axis.

25. The machine of claim 24, further comprising a hydrostatic counterbalancing mechanism that includes:

a cylinder bore in fluid communication with a source of pressurized fluid, and including a first working surface;

a piston positioned within the cylinder bore and including a second working surface; and the counterbalancing mechanism being operatively coupled to the back plate and configured such that fluid pressure acting on the first and second working surfaces reduces a net hydrostatic force acting on the back plate.

26. The machine of claim 24 wherein the angle control means includes means for changing the angle of the second axis to positive angles and to negative angles relative to the first axis.

27. The machine of claim 24 wherein the axial position control means controls the distance between the cylinder barrel and the third axis so that the distance is reduced as the angle of the second axis relative to the first axis is reduced, and increased as the angle is increased.

* * * * *